US007566056B2

(12) United States Patent
Sorge

(10) Patent No.: US 7,566,056 B2
(45) **Date of Patent: *Jul. 28, 2009**

(54) ROULETTE GAME APPARATUS AND METHOD

(76) Inventor: Nicholas Sorge, 7 Susan Ct., Deer Park, NY (US) 11729

( * ) Notice: Subject to any disclaimer, the term of this patent is extended or adjusted under 35 U.S.C. 154(b) by 323 days.

This patent is subject to a terminal disclaimer.

(21) Appl. No.: 11/593,322

(22) Filed: Nov. 6, 2006

(65) Prior Publication Data

US 2007/0222146 A1 Sep. 27, 2007

Related U.S. Application Data

(63) Continuation-in-part of application No. 11/389,197, filed on Mar. 24, 2006.

(51) Int. Cl.
*A63F 71/00* (2006.01)

(52) U.S. Cl. ..... 273/143 R

(58) Field of Classification Search ..... None
See application file for complete search history.

(56) References Cited

U.S. PATENT DOCUMENTS

| | | | | |
|---|---|---|---|---|
| D92,059 | S | 4/1934 | Anderson | |
| D106,967 | S | 11/1937 | Danon | |
| 4,077,631 | A | 3/1978 | Tela, Sr. | |
| 4,149,728 | A * | 4/1979 | Thompson | 273/274 |
| 4,357,015 | A * | 11/1982 | Santora et al. | 463/22 |
| 4,396,193 | A * | 8/1983 | Reinhardt et al. | 463/22 |
| 5,540,442 | A * | 7/1996 | Orselli et al. | 463/17 |
| 5,553,851 | A * | 9/1996 | Malavazos et al. | 273/142 E |
| 5,636,838 | A * | 6/1997 | Caro | 273/142 E |
| 5,934,999 | A * | 8/1999 | Valdez | 463/17 |
| 6,047,965 | A * | 4/2000 | Mollo et al. | 273/142 E |
| 6,352,260 | B1 * | 3/2002 | Santiago | 273/274 |
| 6,406,021 | B1 | 6/2002 | Nadibaidze | |
| 6,406,022 | B1 | 6/2002 | Nadibaidze | |
| 6,921,072 | B2 * | 7/2005 | Hughes-Watts | 273/142 E |
| 2003/0094752 | A1 | 5/2003 | Mathews | |
| 2005/0192076 | A1 | 9/2005 | Lowery | |
| 2005/0192079 | A1 | 9/2005 | Lowery | |
| 2006/0009274 | A1 | 1/2006 | Finocchio | |

OTHER PUBLICATIONS

U.S. Appl. No. 11/725,073.

(Continued)

*Primary Examiner*—Gene Kim
*Assistant Examiner*—Dolores Collins
(74) *Attorney, Agent, or Firm*—Scully, Scott, Murphy & Presser, P.C.

(57) ABSTRACT

A method for arranging indicia on a game surface and on an associated roulette wheel. Indicia indicating numbers from 1 through 36 are arranged on the game surface in ascending order with half of the numbers associated with a first color and half associated with a second color. The numbers are arranged in three groups of twelve, each group having three even numbers and three odd numbers associated with each of the two colors. Indicia indicating each of the numbers are arranged on a roulette wheel such that no two adjacent numbers on the roulette wheel are associated with a same color, are disposed in a same group, are disposed in a same column, are disposed in a same row, or are disposed adjacent one another on the game surface and such that each pair of numbers disposed substantially diametrically across from one another on the roulette wheel is disposed in a same group and column on the game surface.

4 Claims, 27 Drawing Sheets

OTHER PUBLICATIONS

U.S. Appl. No. 11/787,473.

U.S. Appl. No. 11/389,197.

Trumps, "The American Hoyle or Gentleman's Handbook of Games". *Fitzgerald Publishing Corporation,* 22nd Edition, 374-378 (1923).

* cited by examiner

ROULETTE GAME APPARATUS AND METHOD

CROSS REFERENCE TO RELATED APPLICATIONS

This application is a Continuation-in-Part of U.S. patent application Ser. No. 11/389,197 filed on Mar. 24, 2006, which is hereby incorporated herein by reference.

BACKGROUND OF THE INVENTION

1. Field of the Invention

The invention relates to apparatuses for playing roulette and methods for arranging indicia on roulette game surfaces and roulette wheels.

2. The Prior Art

Roulette is a well-known game of chance enjoyed throughout the world. The equipment used for playing roulette generally comprises a roulette wheel and a game surface.

The roulette wheel generally comprises a horizontally disposed wheel mounted in a bowl-shaped housing. The wheel is adapted to rotate about a vertical axis and includes a plurality of pockets disposed around its periphery. Each pocket has a unique number associated with the pocket, as well as a color associated therewith. Each pocket is adapted to receive a small ball which is introduced into the bowl-shaped housing by an operator or croupier as the wheel is set in motion. The wheel is typically spun in one direction and the ball projected around the circumference of the housing in an opposite direction. As the ball loses speed, it rolls down the concave housing wall, eventually coming to rest in one of the pockets. The outcome or result of the spin is the number and color associated with the pocket in which the ball comes to rest.

The game surface includes a plurality of wagering areas indicating various numbers, colors, parities (the odd or even quality of a number) and groupings of numbers. One or more players make wagers on a predicted outcome of a spin of the roulette wheel. A players indicates his or her wager by placing one or more wagering devices, such as chips or markers representing an amount of the wager, at a predetermined location on the game surface corresponding to a predicted outcome of a spin of the roulette wheel.

A prior art roulette game surface or board is shown in FIG. 1. As shown the game surface includes wagering areas corresponding to the individual numbers 1 through 36. The numbers are arranged sequentially in three columns of twelve numbers each and twelve rows or streets of three numbers each. Eighteen of the numbers (1, 3, 5, 7, 9, 12, 14, 16, 18, 19, 21, 23, 25, 27, 30, 32, 34 and 36) correspond to a first color, typically red, and the remaining eighteen numbers (2, 4, 6, 8, 10, 11, 13, 15, 17, 20, 22, 24, 26, 28, 29, 31, 33 and 35 correspond to a second color, typically black. In the prior art arrangement, there are eight even red numbers (12, 14, 16, 18, 30, 32, 34 and 36), ten odd red numbers (1, 3, 5, 7, 9, 19, 21, 23, 25, and 27), ten even black numbers (2, 4, 6, 8, 10, 20, 22, 24, 26 and 28) and eight odd black numbers (11, 13, 15, 17, 29, 31, 33 and 35).

A player may place a wager on a particular number by placing one or more chips or markers within the wagering area corresponding to that number. In addition, players can wager on groupings of individual numbers. For example, a player can wager on a column of numbers by placing one or more chips or markers adjacent to the column of numbers, on a row of numbers by placing one or more chips or markers adjacent to the row of numbers, on two rows of numbers by placing one or more chips or markers adjacent to the two rows of numbers, and on four adjoining numbers by placing one or more chips or markers at the intersection of the four adjoining numbers.

As shown in FIG. 1, wagering areas are also typically provided for betting on the number 0 (and/or the number 00 in an American style wheel as described more fully herein), on a particular color outcome (for example red or black), on an even or odd number outcome, on an outcome comprising a number from 1 to 18, on an outcome comprising a number from 19 to 36 and on a particular set or block of numbers (for example first twelve number 1 through 12, second twelve numbers 13 through 24 or last twelve numbers 25 through 36).

Winning wagers in the game of roulette are paid out at predetermined multiples based on the probability of the particular predicted outcome. For example, a winning wager for an individual number may pay out at a ratio of 35 to 1; a winning wager for a row of three numbers may pay out at a ratio of 11 to 1; a winning wager for a group of four adjacent numbers may pay out at a ratio of 8 to 1; a winning wager for two adjacent rows of number may pay out at a ratio of 5 to 1; a winning wager for the combination of numbers 1 to 18 or the combination of numbers from 19 to 36 may pay out at a ratio of 1 to 1; a winning wager on a column of numbers may pay out at a ratio of 2 to 1; a winning wager on a block of twelve consecutive numbers (first twelve, second twelve or last twelve) may pay out at a ratio of 2 to 1, and a winning wager on an odd number; an even number, a red number or a black number may pay out even money. Other wager combinations and associated payout ratios may also be used.

The prior art American roulette wheel arrangement is shown in FIG. 2. As shown, the prior art American wheel includes both zero (0) and double zero (00) house numbers arranged opposite each other and thirty six numbers from 1 to 36 arranged around the perimeter of the wheel for a total of thirty eight pockets. The house numbers (0, 00) are typically green in color. The numbers 1, 3, 5, 7, 9, 12, 14, 16, 18, 19, 21, 23, 25, 27, 30, 32, 34 and 36 are red, and the numbers 2, 4, 6, 8, 10, 11, 13, 15, 17, 20, 22, 24, 26, 28, 29, 31, 33 and 35 are black.

The numbers from 1 to 36 are arranged at standardized positions on the prior art American wheel as shown. Black and red numbers alternate and directly across the wheel from each odd number is the next highest even number (for example the number 10 is directly across the wheel from the number 9).

FIG. 3 shows the prior art European roulette wheel arrangement. As shown, the European roulette wheel arrangement includes only one house number, the single zero (0) and thirty six numbers, for a total of thirty seven pockets. This results in a significantly lower house advantage for the European wheel (approximately 2.70%) as compared to the American wheel (approximately 5.26%). The individual numbers from 1 to 36 in the prior art European roulette wheel have the same colors as they have in the prior art American roulette wheel, and the numbers are also arranged at standardized positions; however the arrangement of numbers around the wheel differs substantially in the European roulette wheel as compared to the American wheel.

The arrangement of numbers and colors on the prior art roulette game surface shown in FIG. 1 (and used with both the prior art American roulette wheel arrangement shown in FIG. 2 and the prior art European roulette wheel arrangement shown in FIG. 3) is not optimized or balanced with respect to the entire game surface, the individual columns and the individual dozen wagering groups (1-12, 13-24 and 25-36) as set forth below. In particular, the distribution of red, black, odd and even numbers on the prior art roulette game surface is unbalanced and as a result experienced players may combine bets on red, black, even and odd numbers, columns and dozen groups to increase the player's chances of winning a bet. In addition, an inexperienced player may lack the knowledge to take advantage of these relationships, resulting in a greater advantage for the casino or house.

As shown in FIG. 1, the prior art roulette game surface arrangement has ten red odd numbers (1, 3, 5, 7, 9, 19, 21, 23, 25 and 27), but only eight red even numbers (12, 14, 16, 18, 30, 32, 34 and 36). Additionally, the prior art arrangement has ten black even numbers (2, 4, 6, 8, 10, 20, 22, 24, 26, 28), but only eight black odd numbers (11, 13, 15, 17, 29, 31, 33 and 35). This imbalance in the distribution of red, black, odd and even numbers throws off the balance of the individual columns and dozen wagering areas.

In the prior art roulette game surface arrangement, the first column consists of six red numbers (1, 7, 16, 19, 25 and 34). Of these six red numbers, however, four numbers are odd (1, 7, 19 and 25) and only two numbers are even (16 and 34). Moreover, two of the odd red numbers (1 and 7) are in the first dozen wagering area, whereas the second and third dozen wagering areas each have one red odd and one red even number in the first column (16, 19 and 25, 34, respectively). Thus, the first column includes one even red number (16) in the second dozen wagering area, one even red number (34) in the third dozen wagering area, but no even red numbers in the first dozen wagering area.

The first column in the prior art roulette game surface further includes six black numbers (4, 10, 13, 22, 28, and 31). Of these six black numbers, however, four numbers are even (4, 10, 22, and 28) and only two numbers are odd (13 and 31). Moreover, two of the black even numbers (4 and 10) are in the first dozen wagering area, whereas the second and third dozen wagering areas each have one black odd and one black even number in the first column (13, 22 and 28, 31, respectively). Thus the first column includes one odd black number (13) in the second dozen wagering area, one odd black number (31) in the third dozen wagering area, but no odd black numbers in the first dozen wagering area.

In the prior art roulette game surface arrangement, the second column consists of four red numbers (5, 14, 23 and 32). Of these four red numbers, two are in the second dozen wagering area (14 and 23) while the first and third dozen wagering areas have only one red number each (5 and 32, respectively). Additionally, the first dozen wagering area includes no even red numbers in the second column and the third dozen wagering area includes no odd red numbers in the second column.

The second column in the prior art roulette game surface further includes eight black numbers (2, 8, 11, 17, 20, 26, 29 and 35). Of these eight black numbers, three (2, 8 and 11) are in the first dozen wagering area and three (26, 29 and 35) are in the third dozen wagering area, while the second dozen wagering area only includes two black numbers (17 and 20). Morever, the first dozen wagering area includes two even black numbers (2 and 8) and only one odd black number (11) in the second column. The third dozen wagering area includes two black odd numbers (29 and 35) and only one black even number (26) in the second column. The second wagering area includes one black odd number (17) and one black even number (20) in the second column.

In the prior art roulette game surface arrangement, the third column consists of eight red numbers (3, 9, 12, 18, 21, 27, 30 and 36). Of these eight red numbers, three (3, 9 and 12) are in the first dozen wagering area and three (27, 30 and 36) are in the third dozen wagering area, while the second dozen wagering area includes only two red numbers (18 and 21). Morever, the first dozen wagering area includes two odd red numbers (3 and 9) and only one even red number (12) in the second column. The third dozen wagering area includes two red even numbers (30 and 36) and only one red odd number (27) in the second column. The second wagering area includes one red even number (18) and one red odd number (21) in the second column.

The third column in the prior art roulette wheel arrangement further includes four black numbers. Of these four black numbers, two are in the second dozen wagering area (15 and 24) while the first and third dozen wagering areas have only one black number each (6 and 33, respectively). Additionally, the first dozen wagering area includes no odd black numbers in the third column and the third dozen wagering area includes no even black numbers in the third column.

Turning to the dozen wagering areas or groups on the prior art roulette game surface, the first dozen wagering area (1-12) includes six red numbers (1, 3, 5, 7, 9 and 12) and six black numbers (2, 4, 6, 8, 10 and 11). However of the six red numbers, five are odd (1, 3, 5, 7 and 9) and only one is even (12). Moreover, of the six black numbers in the first dozen wagering area, five are even (2, 4, 6, 8 and 10) and only one is odd (11). Accordingly, the first dozen wagering area of the prior art roulette game surface is unbalanced with respect to the distribution of red, black, odd and even numbers.

The second dozen wagering area (13-24) of the prior art roulette game surface arrangement includes six red numbers (14, 16, 18, 19, 21 and 23), three of which are even (14, 16 and 18) and the remaining three (19, 21 and 23) of which are odd. This represents a balanced arrangement. Moreover, the second dozen wagering area includes six black numbers (13, 15, 17, 20, 22 and 24), three of which are odd (13, 15 and 17) and the remaining three of which are even (20, 22 and 24). This represents a balanced arrangement.

The third dozen wagering area (25-36) of the prior art roulette game surface arrangement includes six red numbers (25, 27, 30, 32, 34 and 36) and six black numbers (26, 29, 31, 33 and 35). However of the six red numbers, four are even (30, 32, 34 and 36) and only two are odd (25 and 27). Moreover, of the six black numbers in the third dozen wagering area, four are odd (29, 31, 33 and 35) and only two are even (26 and 28). Accordingly, the third dozen wagering area of the prior art roulette game surface is also unbalanced with respect to the distribution of red, black, odd and even numbers.

In addition to the uneven distribution of red, black, odd and even numbers on the prior art roulette game surface, it has been observed that the arrangement of corresponding numbers on the prior art roulette wheels (both American and European) has a relationship to various arrangements of colors, odds, evens, columns and groups on the roulette game surface as set forth below.

The relationships among adjacent numbers on the prior art roulette wheels and their corresponding positions, groupings and characteristics on the prior art roulette game surface may allow experienced players to combine bets on red, black, even and odd numbers, columns and dozen groups to increase the player's chances of winning. For example in the prior art arrangements, players may "flower" the wheel by placing bets corresponding to a group of numbers positioned on the roulette wheel adjacent or in close proximity to one another. By utilizing progressive betting techniques and taking advantage of the relationship between the positions of the numbers on the roulette wheel and the various betting schemes (red, black, odd, even, column, dozen group) a professional or experienced player may increase his or her odds of winning.

As shown in FIG. 2 and FIG. 1, the following relationships exist between the arrangement of numbers on the prior art American roulette wheel and the corresponding prior art game surface. Moving clockwise from the double zero (00) house number, the numbers 10 and 25 are adjacent to one another on the wheel and are in the same column, namely the first column, on the game surface. Numbers 25 and 29 are adjacent to one another on the wheel, are both odd numbers, are diagonally adjacent to one another on the game surface and and are in the same group, namely the third dozen wagering area, on the game surface. Numbers 12 and 8 are adjacent to one another on the wheel, are both even, are diagonally adjacent to one another on the game surface, and are both in the same group, namely the first dozen wagering area, on the game surface. Numbers 19 and 31 are adjacent to one another on the wheel, are both odd and are in the same column, namely the first column, on the game surface. Numbers 18 and 6 are adjacent to one another on the wheel, are both even and are in the same column, namely the third column, on the game surface.

Moreover, the three numbers 18, 6 and 21 are arranged consecutively on the wheel, and all are in the same column, namely the third column, on the game surface. The numbers 18 and 21 are also in the same group, the second dozen wagering area, and adjacent to one another on the game surface (18 is positioned directly above 21).

The four numbers 18, 6, 21 and 33 are arranged consecutively on the wheel, and all are in the same column, namely the third column, on the game surface. The numbers 18 and 21 are adjacent one another on the game surface, and 18 and 6 are both even numbers and adjacent to one another on the wheel. The numbers 21 and 33 are both odd numbers and adjacent on the wheel. Two of the numbers from this grouping (18 and 21) are in the second dozen wagering area, wherein 6 is in the first dozen wagering area and 33 is in the third wagering area. Accordingly, this grouping of numbers is unbalanced.

The numbers 16 and 4 are adjacent to one another on the wheel, are both even and are in the same column, namely the first column, on the game surface. The numbers 23 and 35 are adjacent to one another on the wheel, are both odd and are in the same column, namely the second column, on the game surface.

The three numbers 23, 35 and 14 are arranged consecutively on the wheel, and all three are in the same column, namely the second column, on the game surface. Two of the numbers from this group (23, 35) are odd numbers.

The four numbers 23, 35, 14 and 2 are arranged consecutively on the wheel and all four are in the same column, namely the second column of the game surface. Two of the numbers from this grouping (14 and 23) are in the second dozen wagering area, wherein 2 is in the first dozen wagering area and 35 is in the third wagering area. Accordingly, this grouping of numbers is unbalanced.

The groups of four consecutive numbers on the wheel consisting of first group 18, 6, 21 and 33, which are all in the third column on the game surface, and second group 23, 35, 14 and 2, which are all in the second column on the game surface, are only separated on the prior art wheel by a single pair of adjacent numbers, 16 and 4. This grouping of ten consecutive numbers on the prior art American roulette wheel is not balanced by any corresponding grouping on the other side of the wheel.

Moving clockwise from the single zero (0) house number of the prior art American roulette wheel layout shown in FIG. 2, the numbers 26 and 30 are adjacent to one another on the wheel, are both even, are both in the third dozen wagering area on the game surface and are diagonally adjacent on the game surface. The numbers 11 and 7 are adjacent to one another on the wheel, are both odd and are both in the first dozen wagering area on the game surface. The numbers 20 and 32 are adjacent to one another on the wheel, are both even and are both in the same column, namely column 2, on the game surface.

The three numbers 20, 32 and 17 are arranged consecutively on the wheel, and all three are in the same column, namely the second column, on the game surface. Two of the numbers from this group (20 and 32) are even numbers. The numbers 20 and 17 are adjacent to each other on the game surface and both in the second dozen wagering area. The four numbers 20, 32, 17 and 5 are arranged consecutively on the wheel, and all four are in the same column, namely the second column, on the game surface. The numbers 20 and 32 are both even. Two numbers from this grouping (17 and 20) are in the second dozen wagering area, one number (5) is in the first dozen wagering area and one number (32) is in the third dozen wagering area. Accordingly, this grouping of numbers is unbalanced.

The numbers 22 and 34 are adjacent to one another on the wheel, both are even and both are in the same column, namely the first column, on the game surface. The numbers 15 and 3 are adjacent to one another on the wheel, both are odd and both are in the same column, namely the third column, on the game surface.

The three numbers 15, 3 and 24 are arranged consecutively on the wheel and are all in the same column, namely the third column, on the game surface. Two of the numbers (15 and 3) are odd numbers. The four numbers 15, 3, 24 and 36 are arranged consecutively on the wheel and all four numbers are in the same column, namely the third column, on the game surface. Two numbers from this grouping (15 and 24) are in the second dozen wagering area, one number (3) is in the first dozen wagering area and one number (36) is in the third dozen wagering area. Accordingly, this grouping of numbers is unbalanced.

The groups of four consecutive numbers on the wheel consisting of first group 20, 32, 17 and 5, which are all in the second column on the game surface, and second group 15, 3, 24 and 36, which are all in the third column on the game surface, are only separated on the wheel by a single pair of adjacent numbers, 22 and 34. This grouping of ten consecutive numbers on the prior art American roulette wheel is not balanced by any corresponding grouping on the other side of the wheel. In particular, there are two numbers (13 and 1) between this grouping of ten numbers (20, 32, 17, 5, 22, 43, 15, 3, 24, and 36) and the house number 00, while the grouping of ten numbers 18, 6, 21, 33, 16, 4, 23, 35, 14 and 2 on the other half of the wheel is adjacent to the house number 0. Thus the groupings are not balanced or symmetric with respect to their arrangement on the wheel.

Additionally, the numbers 13 and 1 are adjacent to one another on the wheel, are both odd and are in the same column, namely the first column, on the game surface.

As shown in FIG. 3 and FIG. 1, the following relationships exist between the arrangement of numbers on the prior art European roulette wheel and the corresponding prior art game surface. Moving clockwise from the house number 0, the numbers 15 and 19 are adjacent to one another on the wheel, are both odd and are both in the second dozen wagering area on the gaming surface. The numbers 4 and 19 are adjacent to each other on the wheel and are in the same column, namely the first column on the game surface. The numbers 6 and 27 are adjacent to one another on the wheel and are in the same column, namely the third column, on the game surface. The numbers 8 and 23 are adjacent to one another on the wheel and are in the same column, namely the second column, on the game surface.

Additionally, on the prior art European roulette wheel, the numbers 10 and 5 are adjacent to one another and both numbers are in the first dozen wagering area on the game surface. The numbers 16 and 24 are adjacent to one another on the wheel, are both even and are both in the second dozen wagering area on the game surface. The numbers 14 and 20 are adjacent to one another on the wheel, are both even, are both in the second column and are both in the second dozen wagering area on the game surface.

The numbers 22 and 18 are adjacent to one another on the wheel, are both even and are both in the second dozen wagering area on the game surface. The numbers 7 and 28 are adjacent to one anther on the wheel and are both in the same column, namely the first column, on the game surface. The numbers 26 and 32 are separated only by the house number 0, are both even, are both in the second column and in the third dozen wagering area of the game surface.

Accordingly there exists a need for improved roulette board game surface and wheel arrangements having a balanced layout wherein red and black and even and odd numbers are evenly distributed. Moreover, the need exists for an improved roulette game surface and wheel arrangement wherein relationships between adjacent pairs or groups of numbers on the wheel and the arrangement and characteristics of numbers on the game surface is eliminated.

SUMMARY OF THE INVENTION

A method for arranging indicia on a game surface and on an associated roulette wheel for a roulette game according to an embodiment of the invention includes arranging indicia indicating one or more house numbers on the game surface. Indicia indicating thirty six whole numbers comprising the numbers 1 through 36 are arranged on the game surface, wherein one half of the whole numbers are associated with a first color and a remaining half of the whole numbers are associated with a second color. The whole numbers are arranged on the game surface in a matrix of three columns and twelve rows in ascending order beginning from a top left corner and proceeding from left to right across the rows.

The whole numbers are arranged in three groups of twelve numbers each, a first group comprising the numbers 1 through 12, a second group comprising the numbers 13 through 24 and a third group comprising the numbers 25 through 36. Each of said first, second and third groups comprises three even numbers associated with the first color, three odd numbers associated with first color, three even numbers associated with the second color and three odd numbers associated with the second color.

Indicia indicating the one or more house numbers are arranged on the roulette wheel. Indicia indicating each of the thirty six whole numbers are arranged on the roulette wheel in a circumferential manner by selecting a first whole number associated with the first color or the second color and disposed in one of the three columns and one of the three groups and indicating the first whole number on the roulette wheel.

A second whole number associated with another of the first color or the second color and disposed in another of the three columns and another of the three groups is selected and indicated on the roulette wheel adjacent to the first number. This pattern is repeated on the roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface. Moreover, the numbers are arranged on the roulette wheel such that each pair of numbers disposed substantially diametrically across from one another on the roulette wheel is disposed in the same group on the game surface and in the same column on the game surface.

Roulette game apparatuses comprising game surfaces and roulette wheels conforming to the method are also disclosed.

An advantage of a method for arranging indicia on a roulette game surface and on an associated roulette wheel and of roulette game apparatuses according to embodiments of the invention is that the relationships between adjacent numbers on the prior art roulette wheel and their corresponding characteristics and positions on the prior art game surface are eliminated or minimized. Accordingly, players using a game surface and roulette wheel according to embodiments of the invention are unable to take advantage of the relationship between the positions of the numbers on the prior art roulette wheel and the betting combinations available on the prior art game surface to increase their odds of winning.

The game surface and wheel arrangements according to embodiments of the invention achieve fairness, balance and consistency for the player and casino by providing a perfect balance of red, black, odd and even numbers on the game surface and a roulette wheel layout which is matched to a corresponding game surface or board to eliminate relationships between groups of numbers on the wheel and betting arrangements on the game surface.

A further advantage of a roulette wheel arrangement according to a method and apparatus of the invention is that an arrangement may be provided wherein an American and European wheel for use with a common game surface have substantially the same arrangement of numbers. This feature may increase player interest, as players familiar with one of the American or European roulette wheel arrangement will also be easily familiarized with the other style wheel.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements.

DETAILED DESCRIPTION OF THE PREFERRED EMBODIMENTS

Figure 1:
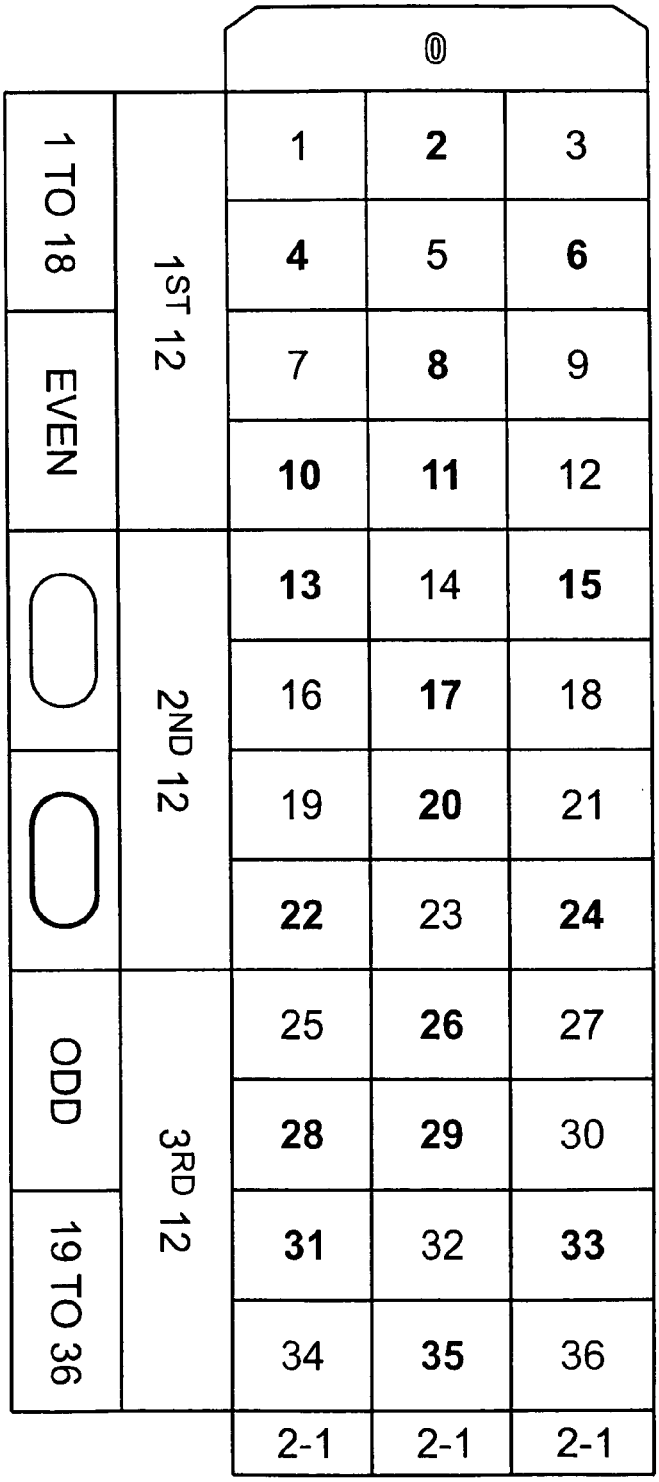
FIG. 1 (Prior Art)
FIG. 1 shows a prior art game surface for a roulette game.

In the drawings, numbers and symbols in regular typeface indicate a first color, for example red. Numbers and symbols in bold typeface indicate a second color, for example black. Numbers in an outline type format indicate a third color, for example green.

Figure 10:
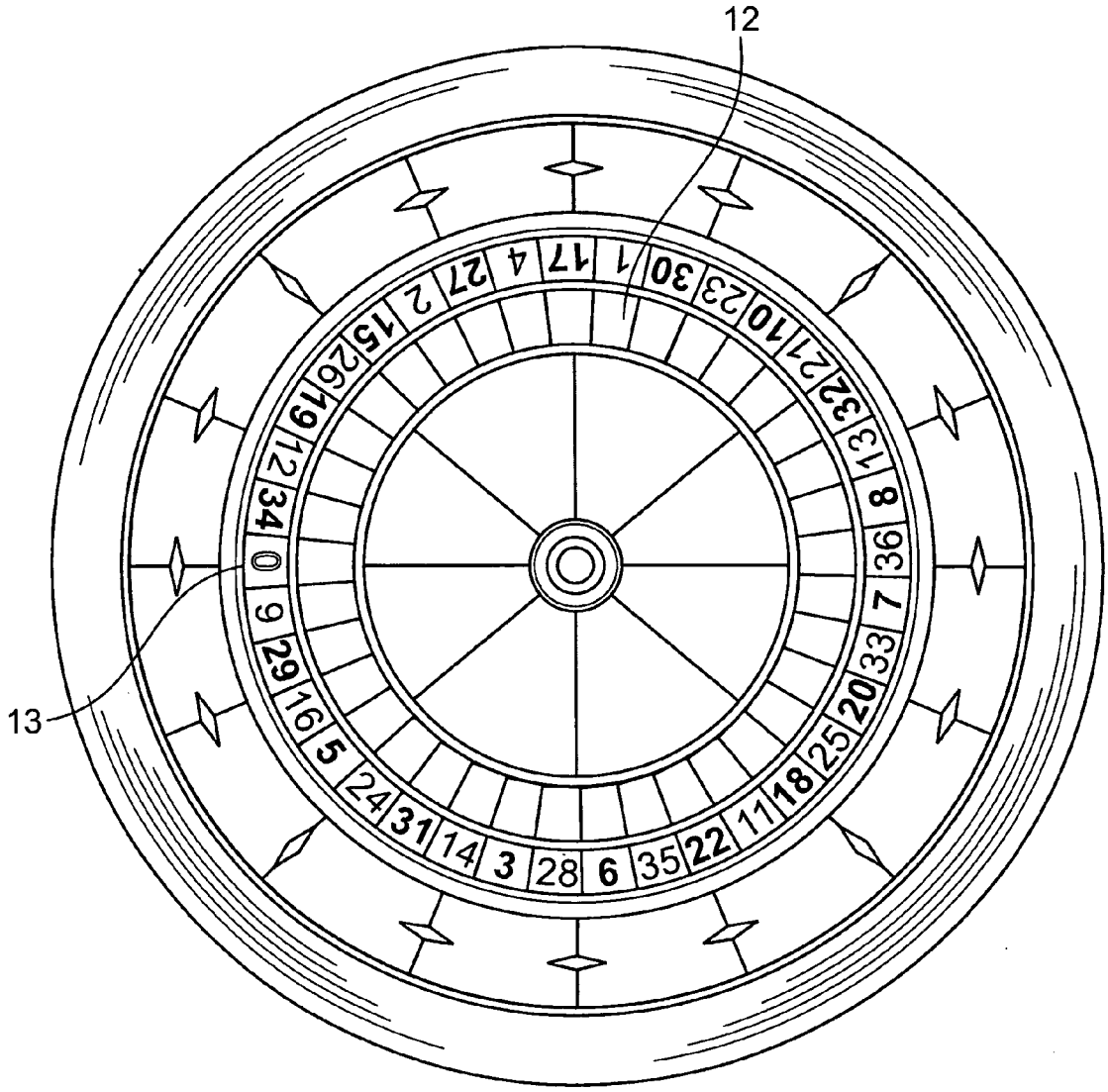
FIG. 10 shows a European roulette wheel arrangement for use with the game surface shown in FIG. 9, according to an embodiment of the invention.
Figure 11:
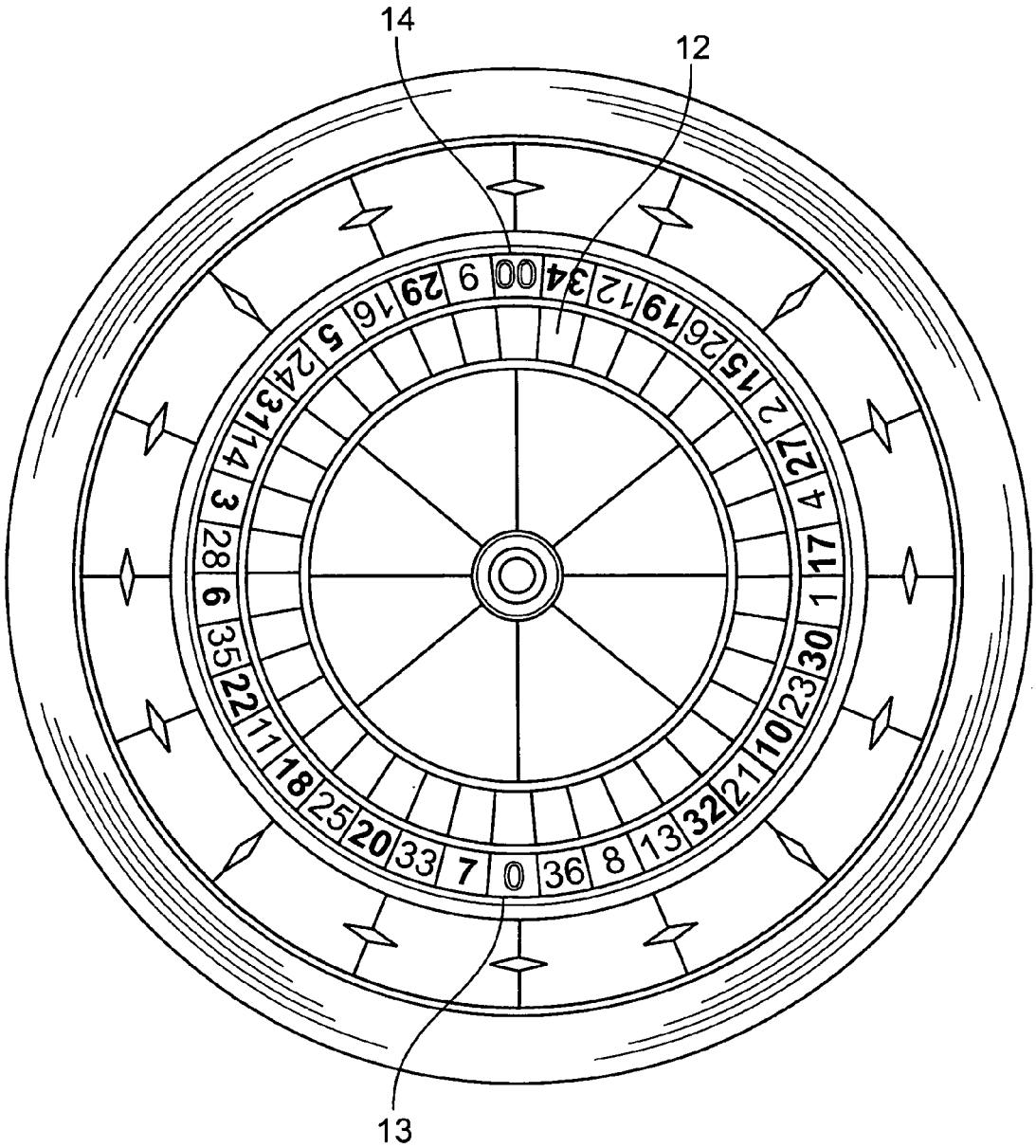
FIG. 11 shows an American roulette wheel arrangement for use with the game surface shown in FIG. 9, according to an embodiment of the invention.
Figure 13:
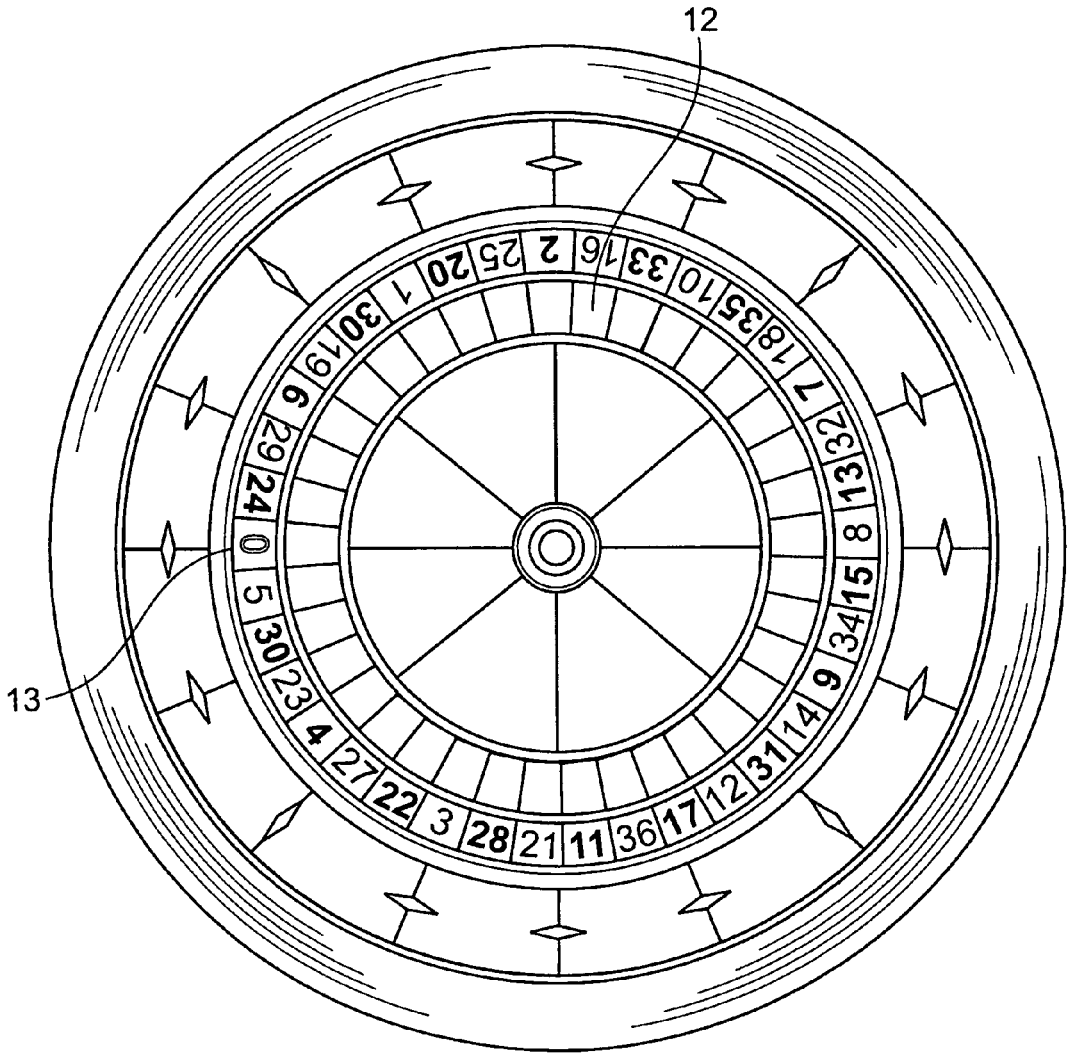
FIG. 13 shows a European roulette wheel arrangement for use with the game surface shown in FIG. 12, according to an embodiment of the invention.
Figure 14:
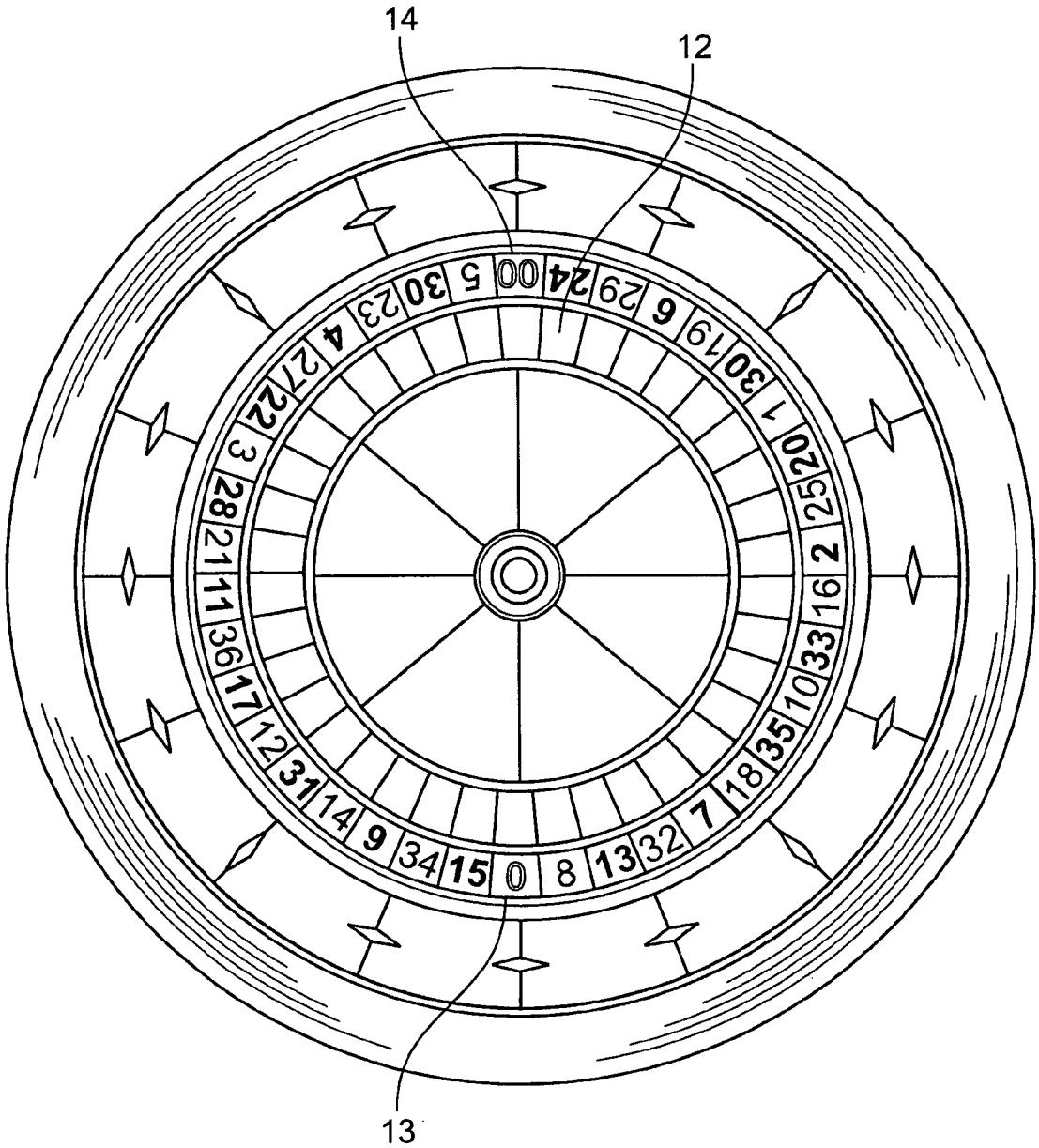
FIG. 14 shows an American roulette wheel arrangement for use with the game surface shown in FIG. 12, according to an embodiment of the invention.
Figure 15:
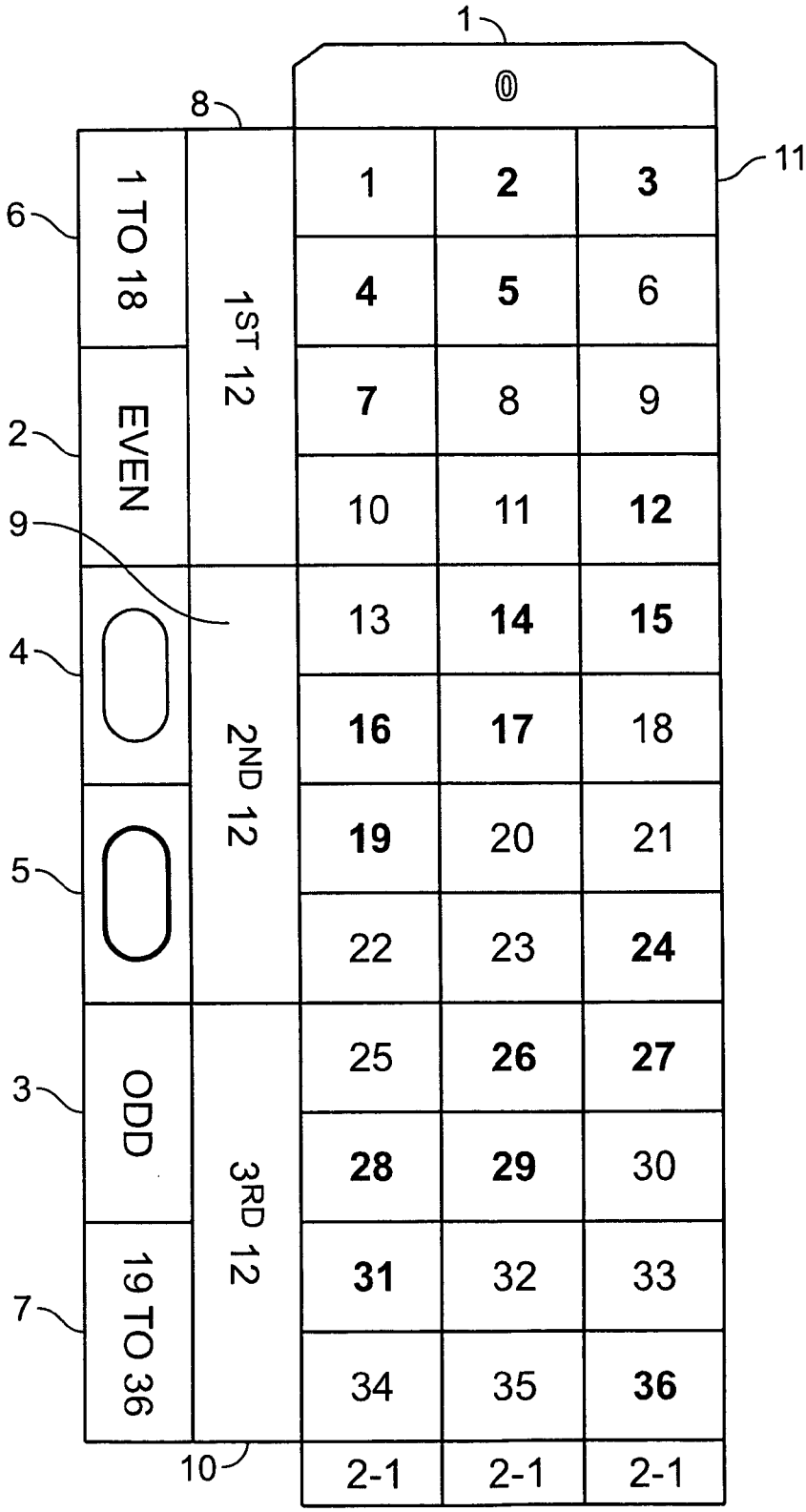
FIG. 15 shows a game surface according to another embodiment of the invention.

FIGS. 4, 9, 12, 15, 24 and 26 show game surfaces according to embodiments of the invention. FIGS. 5, 6, 7, 8, 10, 11, 13, 14, 16, 17, 18, 19, 20, 21, 22, 23, 25 and 27 show roulette wheel arrangements according to embodiments of the invention. In particular, FIGS. 5, 6, 7 and 8 show roulette wheel arrangements suitable for use with the game surface shown in FIG. 4; FIGS. 10 and 11 show roulette wheel arrangements suitable for use with the game surface shown in FIG. 9; FIGS. 13 and 14 show roulette wheel arrangements suitable for use with the game surface shown in FIG. 12; FIGS. 16, 17, 18, 19, 20, 21, 22 and 23 show roulette wheel arrangements suitable for use with the game surface shown in FIG. 15; FIG. 25 shows a roulette wheel arrangement suitable for use with the game surface shown in FIG. 24; and FIG. 27 shows a roulette wheel arrangement suitable for use with the game surface shown in FIG. 26.

FIGS. 5, 7, 11, 14, 16, 18, 20, 22 and 27 show American style roulette wheel arrangements according to embodiments of the invention. As shown, the American style wheels have two house numbers (0 and 00) disposed diametrically opposite one another. FIGS. 6, 8, 10, 13, 17, 19, 21, 23 and 25 show European style roulette wheels according to embodiment of the invention. As shown, the European style wheels include one house number (0).

As illustrated in FIGS. 4, 9, 12, 15, 24 and 26, game surfaces according to embodiments of the invention include one or more house number wagering areas 1 for placing a wager on a house number. The game surfaces also include an even number wagering area 2 for wagering on the even numbers (2, 4, 6, 8, 10, 12, 14, 16, 18, 20, 22, 24, 26, 28, 30, 32, 34 and 36) and an odd number wagering area 3 for wagering on the odd numbers (1, 3, 5, 7, 9, 11, 13, 15, 17, 19, 21, 23, 25, 27, 29, 31, 33 and 35). The game surface further includes a first color wagering area 4 for wagering on numbers associated with a first color, for example red, and a second color wagering area 5 for wagering on numbers associated with a second color, for example black.

A game surface according to an embodiment of the invention further includes a low number wagering area 6 for wagering on the numbers from 1 to 18 and a high number wagering area 7 for wagering on the numbers from 19 to 36. A first dozen wagering area 8 for wagering on the numbers from 1 to 12, a second dozen wagering area 9 for wagering on the numbers from form 13 to 24, and a third dozen wagering area 10 for wagering on the numbers from 25 to 36 are also disposed on the game surface.

Thirty six individual number wagering areas 11, each corresponding to a whole number from 1 to 36 are arranged on the game surface. As shown, the thirty six individual number wagering areas are arranged in ascending order from left to right in a matrix of three columns and twelve rows.

As shown in FIGS. 4, 9, 12, 15, 24 and 26, in a game surface according to an embodiment of the invention, the thirty six individual whole numbers are evenly distributed in a perfectly balanced manner wherein nine odd numbers are associated with a first color (for example red), nine odd numbers are associated with a second color (for example black), nine even numbers are associated with a first color (for example red) and nine even numbers are associated with a second color (for example black).

Moreover, each of the three columns in a game surface according to an embodiment of the invention comprises six numbers associated with the first color and six numbers associated with the second color. Each of the columns in a game surface according to an embodiment of the invention comprises six odd numbers and six even numbers. Each of the columns in a game surface according to an embodiment of the invention comprises three even numbers associated with the first color, three even numbers associated with the second color, three odd numbers associated with the first color and three odd numbers associated with the second color.

Additionally, each of the three groups of twelve numbers corresponding to the first, second and third dozen wagering areas in a game surface according to an embodiment of the invention comprises three even numbers associated with the first color, three even numbers associated with the second color, three odd numbers associated with the first color and three odd numbers associated with the second color.

Figure 4:
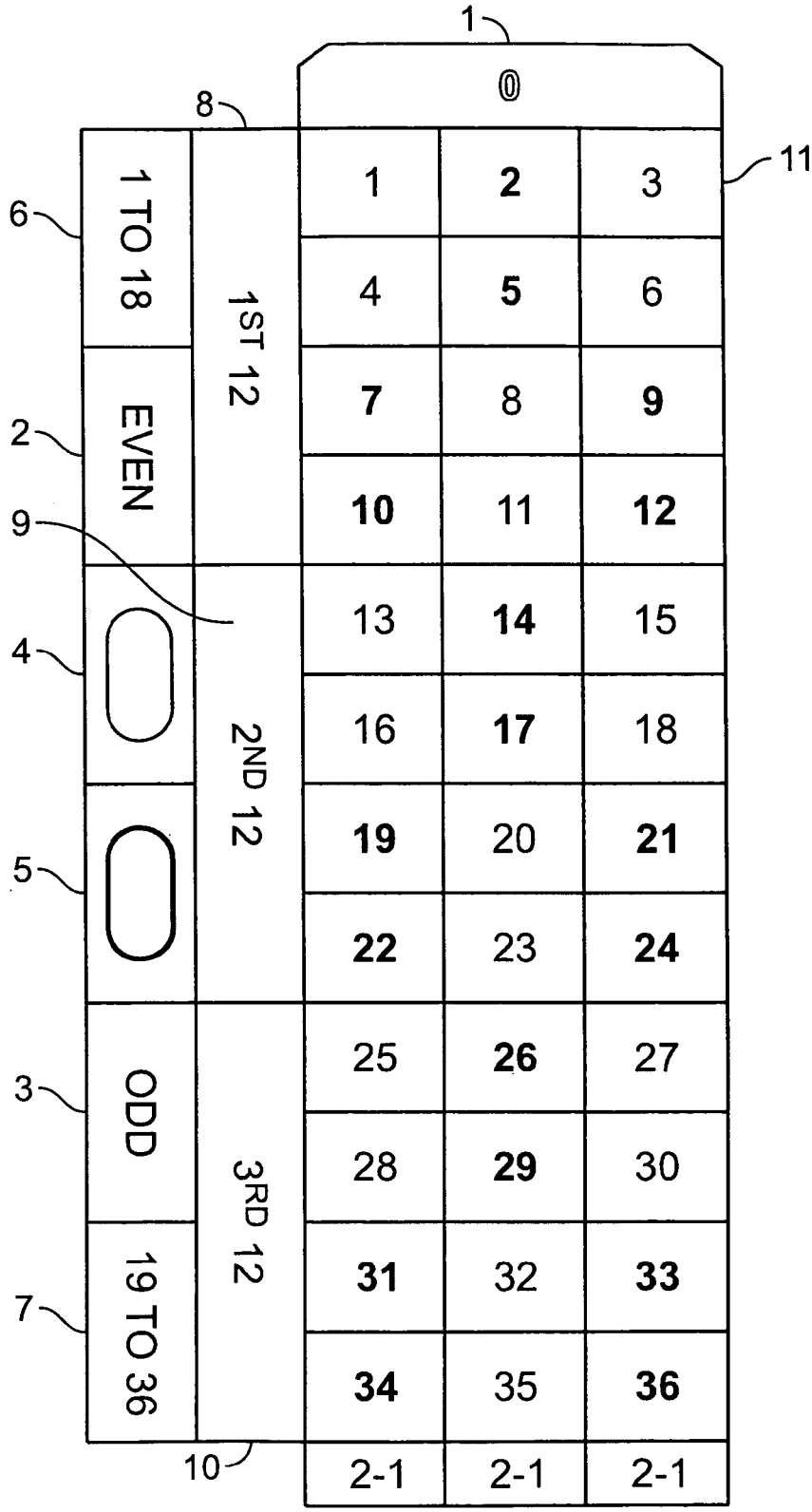
FIG. 4 shows a game surface according to an embodiment of the invention.

For example, as shown in the game surface illustrated in FIG. 4, individual number wagering areas corresponding to numbers 1, 3, 4, 6, 8, 11, 13, 15, 16, 18, 20, 23, 25, 27, 28, 30, 32 and 35 are associated with a first color, and individual number wagering areas corresponding to numbers 2, 5, 7, 9, 10, 12, 14, 17, 19, 21, 22, 24, 26, 29, 31, 33, 34 and 36 are associated with a second color. Likewise, in the game surface embodiment shown in FIG. 9, individual number wagering areas corresponding to numbers 1, 2, 4, 9, 11, 12, 13, 14, 16, 21, 23, 24, 25, 26, 28, 33, 35 and 36 are associated with a first color, and individual number wagering areas corresponding to numbers 3, 5, 6, 7, 8, 10, 15, 17, 18, 19, 20, 22, 27, 29, 30, 31, 32 and 34 are associated with a second color.

Figure 12:
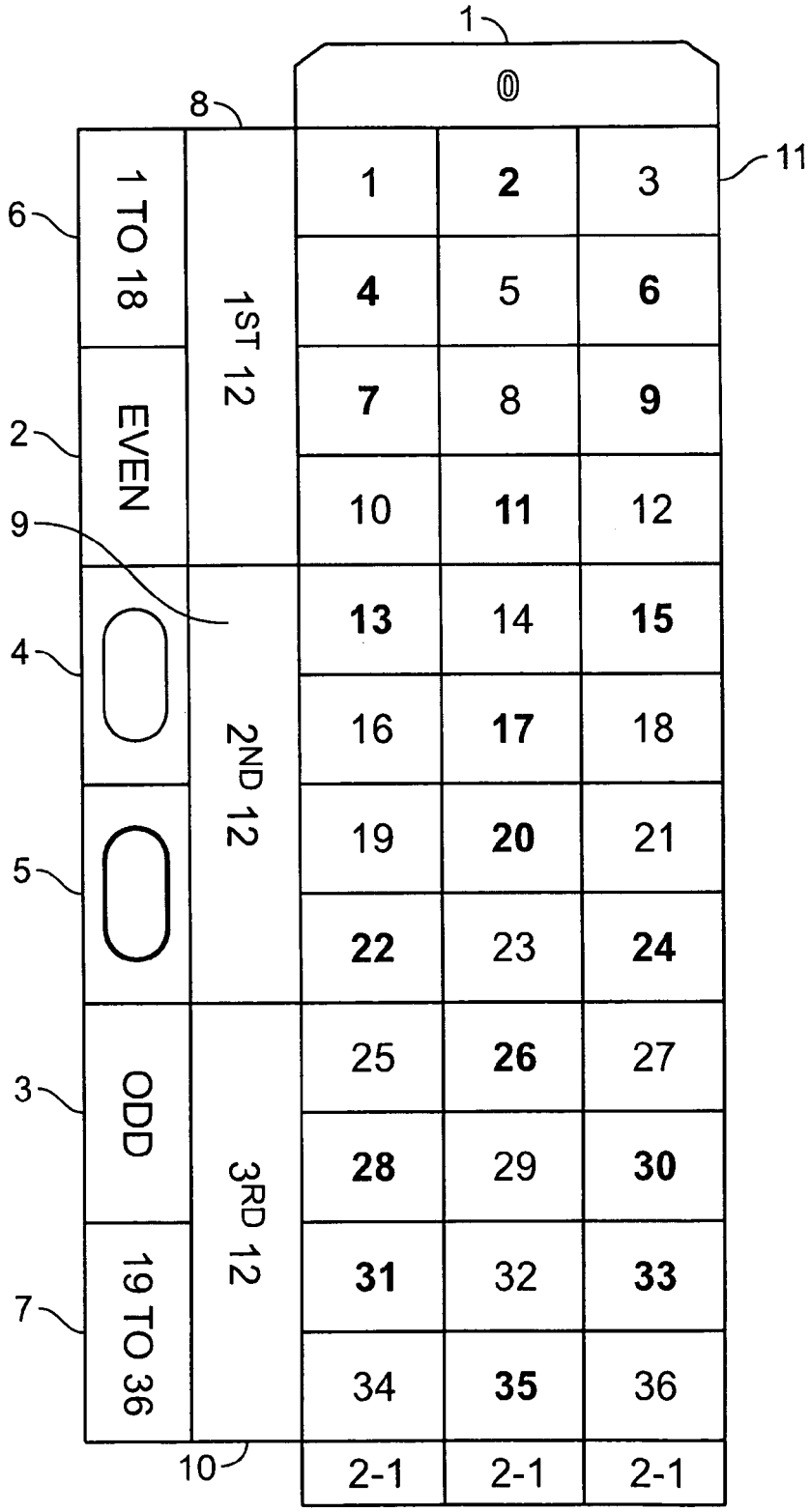
FIG. 12 shows a game surface according to another embodiment of the invention.

In the game surface embodiment shown in FIG. 12, individual number wagering areas corresponding to numbers 1, 3, 5, 8, 10, 12, 14, 16, 18, 19, 21, 23, 25, 27, 29, 32, 34 and 36 are associated with a first color, and individual number wagering areas corresponding to numbers 2, 4, 6, 7, 9, 11, 13, 15, 17, 20, 22, 24, 26, 28, 30, 31, 33 and 35 are associated with a second color. In the game surface embodiment shown in FIG. 15, individual number wagering areas corresponding to numbers 1, 6, 8, 9, 10, 11, 13, 18, 20, 21, 22, 23, 25, 30, 32, 33, 34 and 35 are associated with a first color, and individual number wagering areas corresponding to numbers 2, 3, 4, 5, 7, 12, 14, 15, 16, 17, 19, 24, 26, 27, 28, 29, 31 and 36 are associated with a second color.

Figure 24:
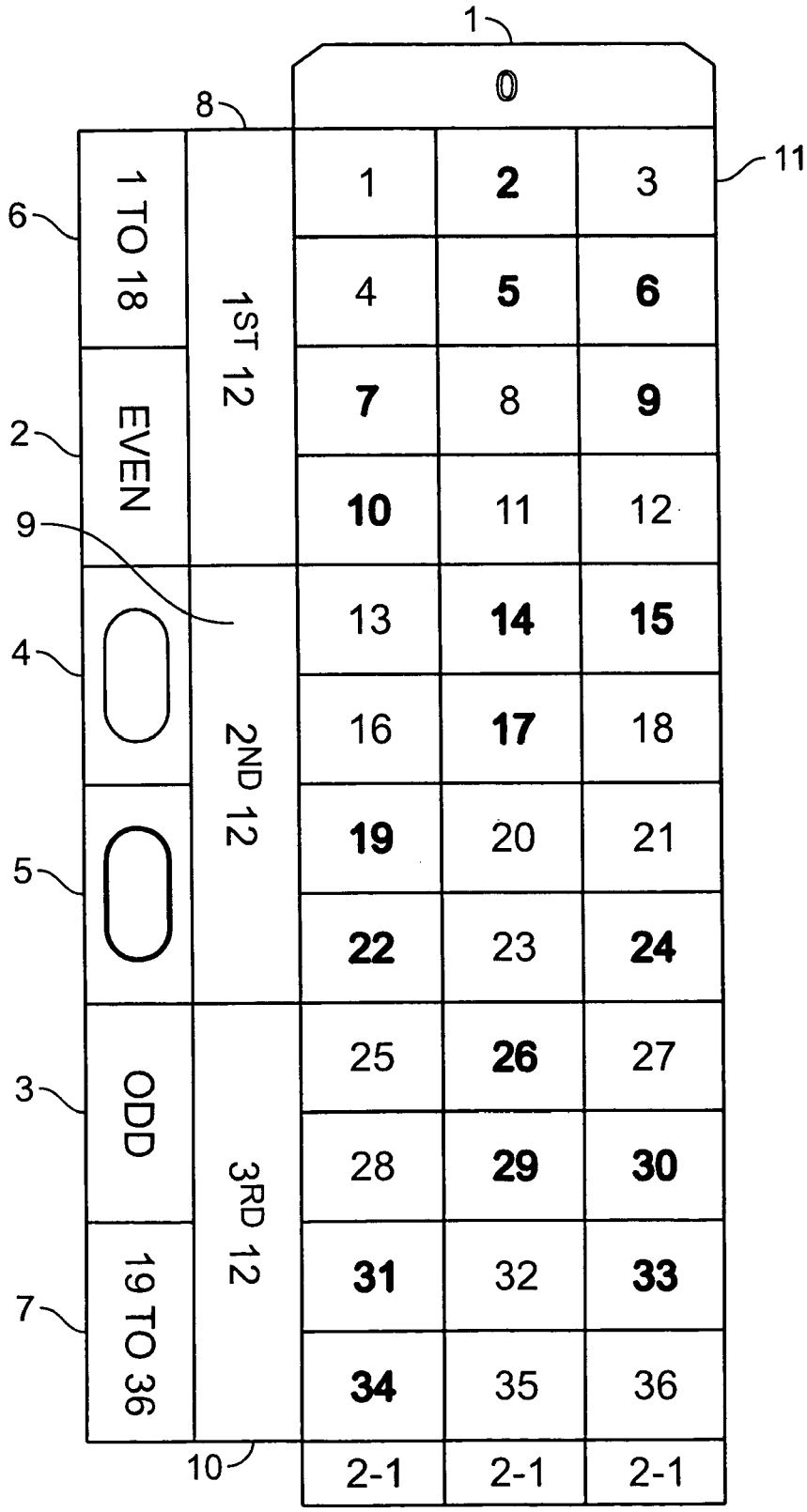
FIG. 24 shows a game surface according to another embodiment of the invention.
Figure 25:
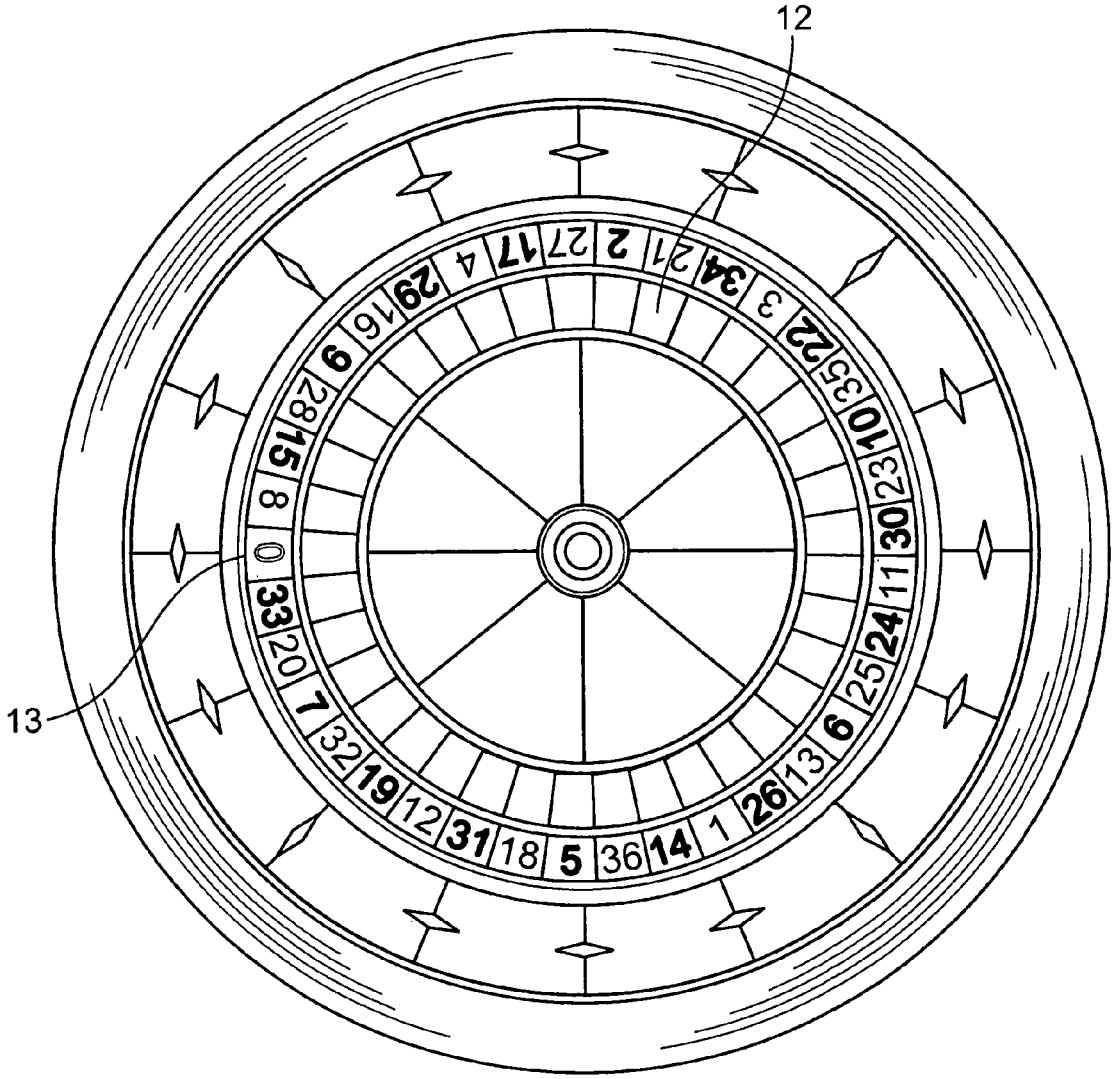
FIG. 25 shows a European roulette wheel arrangement for use with the game surface shown in FIG. 24, according to an embodiment of the invention.
Figure 26:
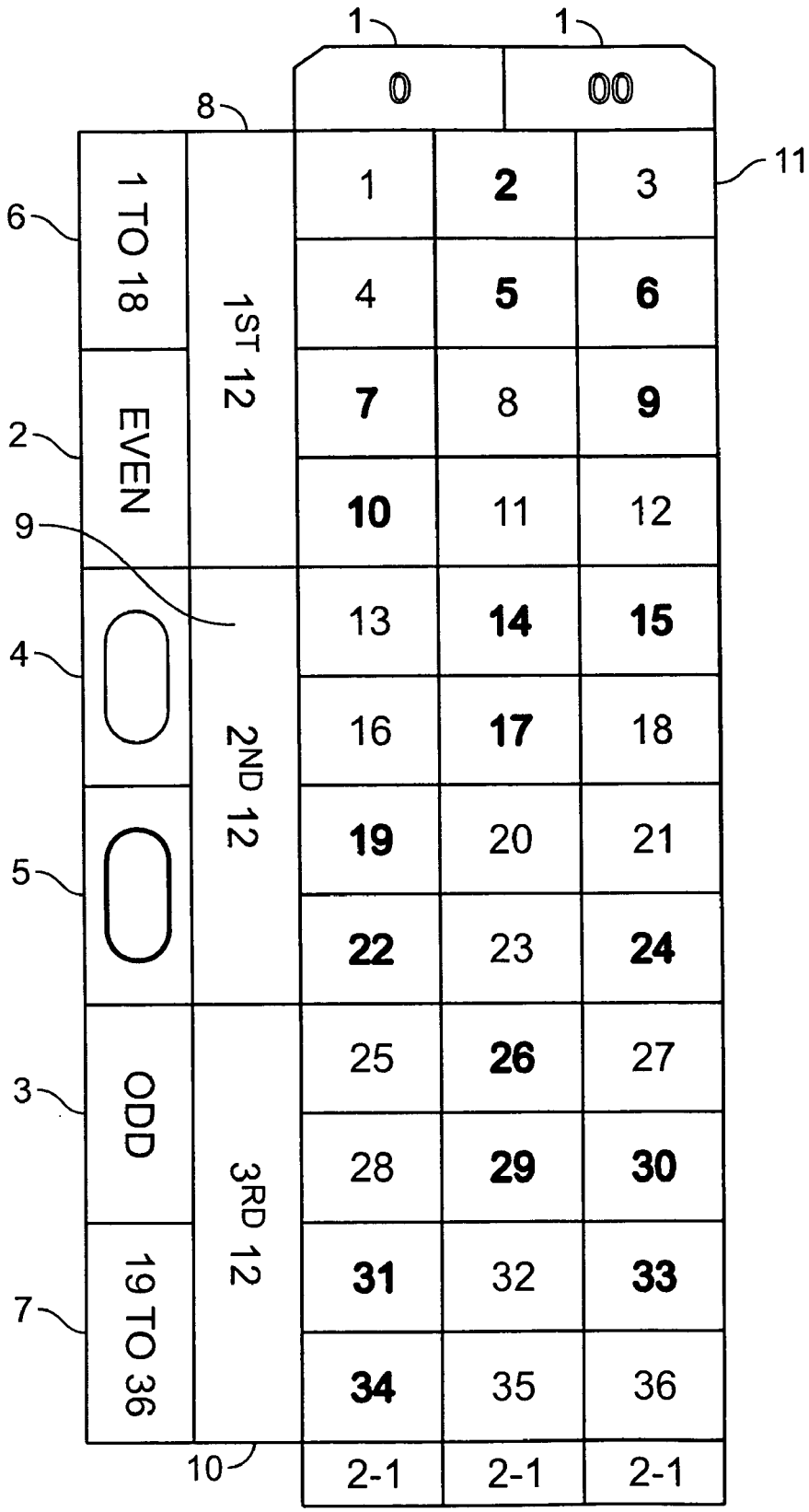
FIG. 26 shows a game surface according to another embodiment of the invention.
Figure 27:
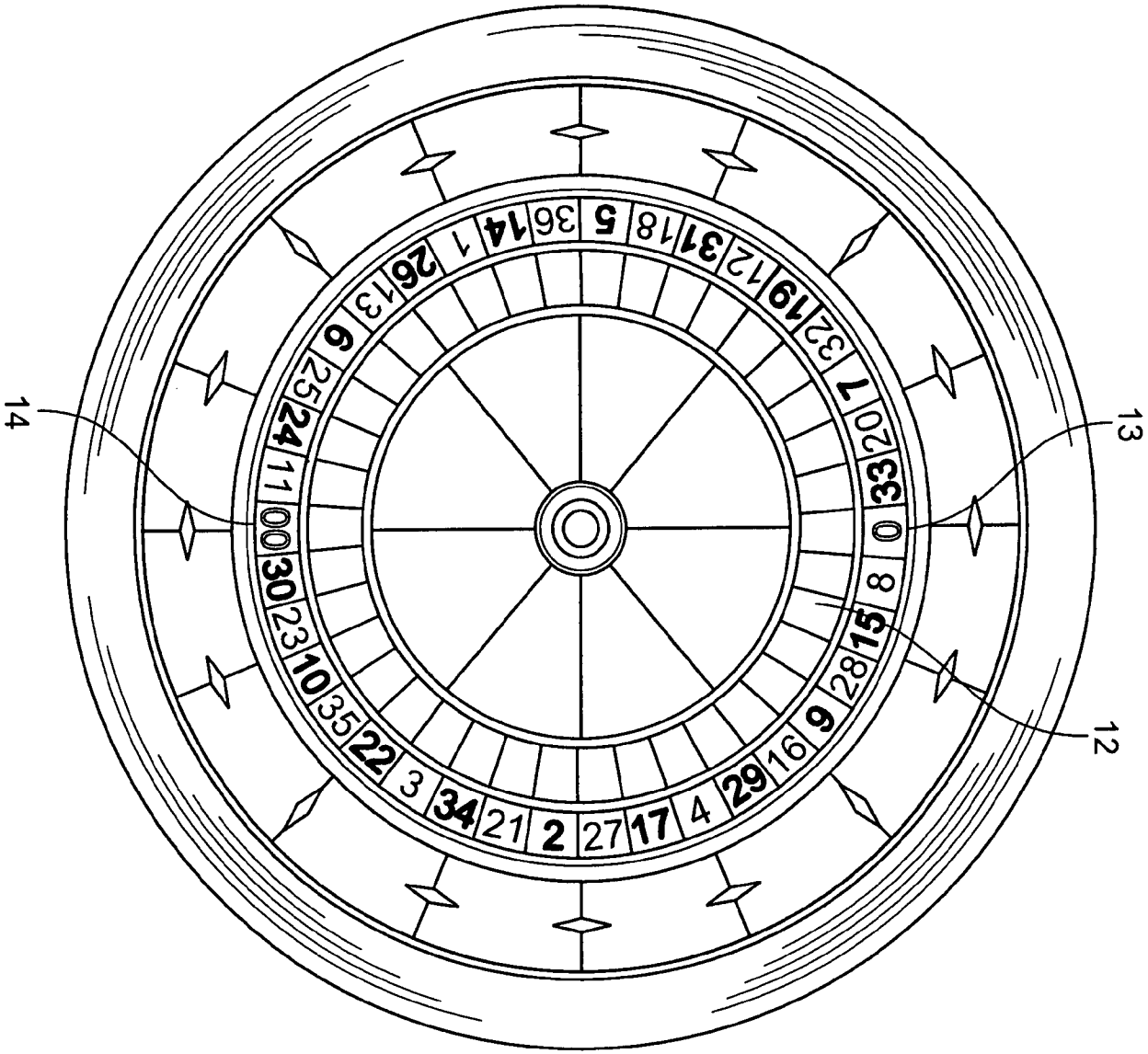
FIG. 27 shows an American roulette wheel arrangement for use with the game surface shown in FIG. 26, according to an embodiment of the invention.

In the game surface embodiments shown in FIGS. 24 and 26, individual number wagering areas corresponding to numbers 1, 3, 4, 8, 11, 12, 13, 16, 18, 20, 21, 23, 25, 27, 28, 32, 35 and 36 are associated with a first color, and individual number wagering areas corresponding to numbers 2, 5, 6, 7, 9, 10, 14, 15, 17, 19, 22, 24, 26, 29, 30, 31, 33 and 34 are associated with a second color.

FIGS. 5, 6, 7, 8, 10, 11, 13, 14, 16, 17, 18, 19, 20, 21, 22, 23, 25 and 27 show roulette wheel arrangements according to embodiments of the invention. As shown, each roulette wheel includes a plurality of pockets 12 disposed in a circumferential manner, For example the American style wheels shown in FIGS. 5, 7, 11, 14, 16, 18, 20, 22 and 27 may have thirty eight pockets and the European style wheels shown in FIGS. 6, 8, 10, 13, 17, 19, 21, 23 and 25 may have thirty seven pockets.

Each of the pockets 12 correspond to either a house number 13, 14 (0 for the European wheel, 0 and 00 for the American wheel) or to one of the whole numbers from 1 to 36. Each of the whole numbers on the wheel is associated with a first color or a second color conforming to the association of numbers and colors on a game surface to be used with the particular wheel.

According to an embodiment of the invention, the pockets and corresponding numbers on the roulette wheel are arranged such that no two adjacent numbers on the roulette wheel are associated with a same color, are disposed in a same group on an associated game surface, are disposed in a same column on an associated game surface, are disposed in a same row on an associated game surface, or are disposed adjacent one another on an associated game surface. In terms of the game surface, two adjacent numbers may be considered as two numbers which are directly above or below one another (for example 4 and 7), side by side (for example 5 and 6) or directly diagonal from one another (for example 10 and 8).

According to a further embodiment of the invention, the pockets and corresponding numbers on the roulette wheel are arranged such that each pair of numbers disposed substantially diametrically across from one another on the roulette wheel is disposed in the same group on the game surface and in the same column on the game surface. The phrase substantially diametrically across from one another refers to numbers which are disposed on the roulette wheel opposite one another along a diameter of the wheel. For example, the following pairs of numbers on the roulette wheel arrangements shown in FIGS. 25 and 27 are considered to be disposed substantially diametrically across from one another: 33 and 30; 20 and 23; 7 and 10; 32 and 35; 19 and 22; 12 and 3; 31 and 34; 18 and 21; 5 and 2; 36 and 27; 14 and 17; 1 and 4; 26 and 29; 13 and 16; 6 and 9; 25 and 28; 24 and 15; and 11 and 8.

Moreover, a roulette wheel according to an embodiment of the invention may be arranged such that all pairs of numbers disposed substantially diametrically across from one another on the roulette wheel are also touching each other on a corresponding game board except for three substantially diametrically opposite pairs, namely 12 and 3; 24 and 15; and 36 and 27.

Figure 5:
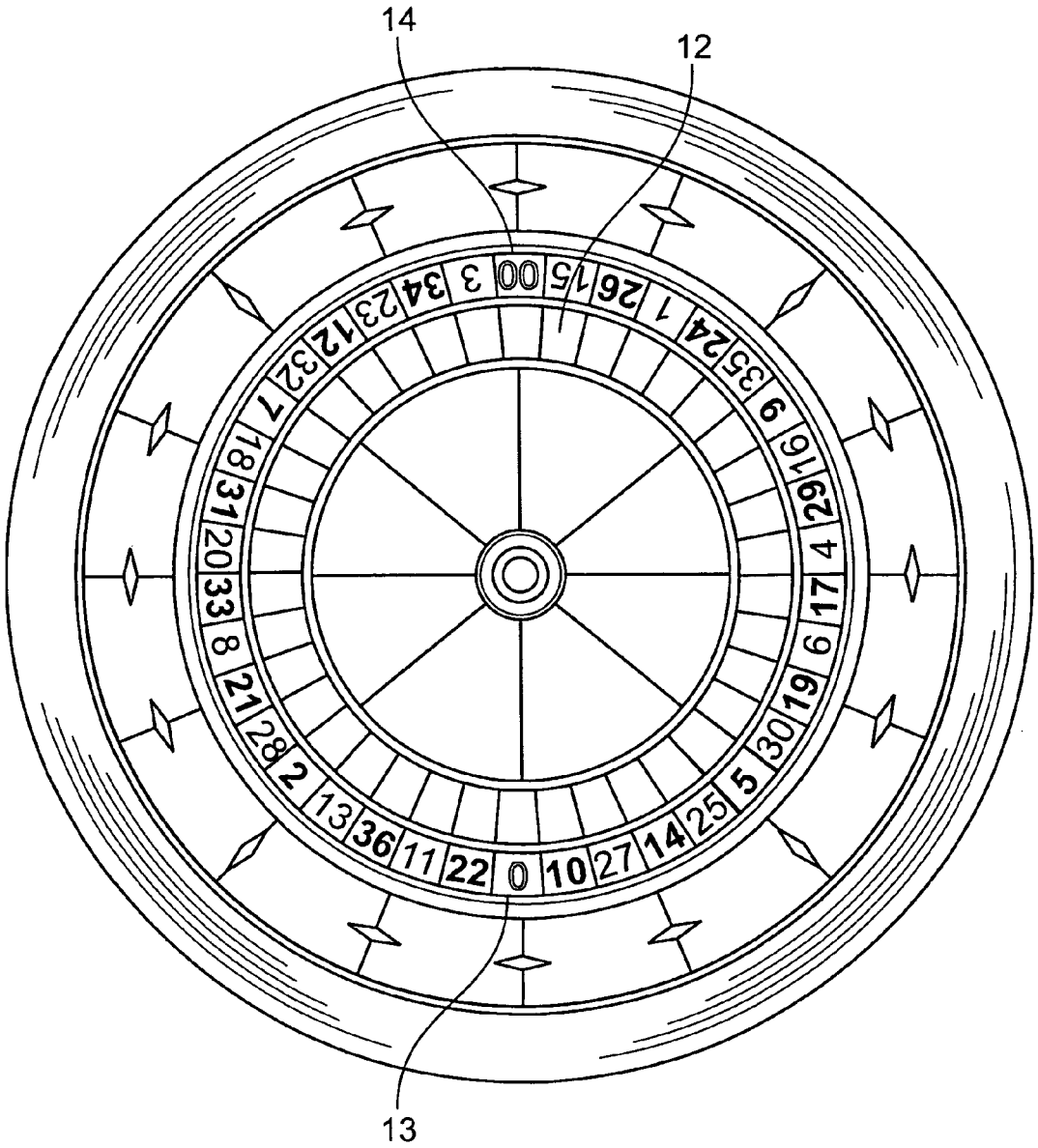
FIG. 5 shows an American roulette wheel arrangement for use with the game surface shown in FIG. 4, according to an embodiment of the invention.

As shown in FIG. 5, the pockets may be arranged in the following clockwise sequence with respect to a corresponding number: a first house number, 22, 11, 36, 13, 2, 28, 21, 8, 33, 20, 31, 18, 7, 32, 12, 23, 34, 3, a second house number, 15, 26, 1, 24, 35, 9, 16, 29, 4, 17, 6, 19, 30, 5, 25, 14, 27 and 10.

Figure 6:
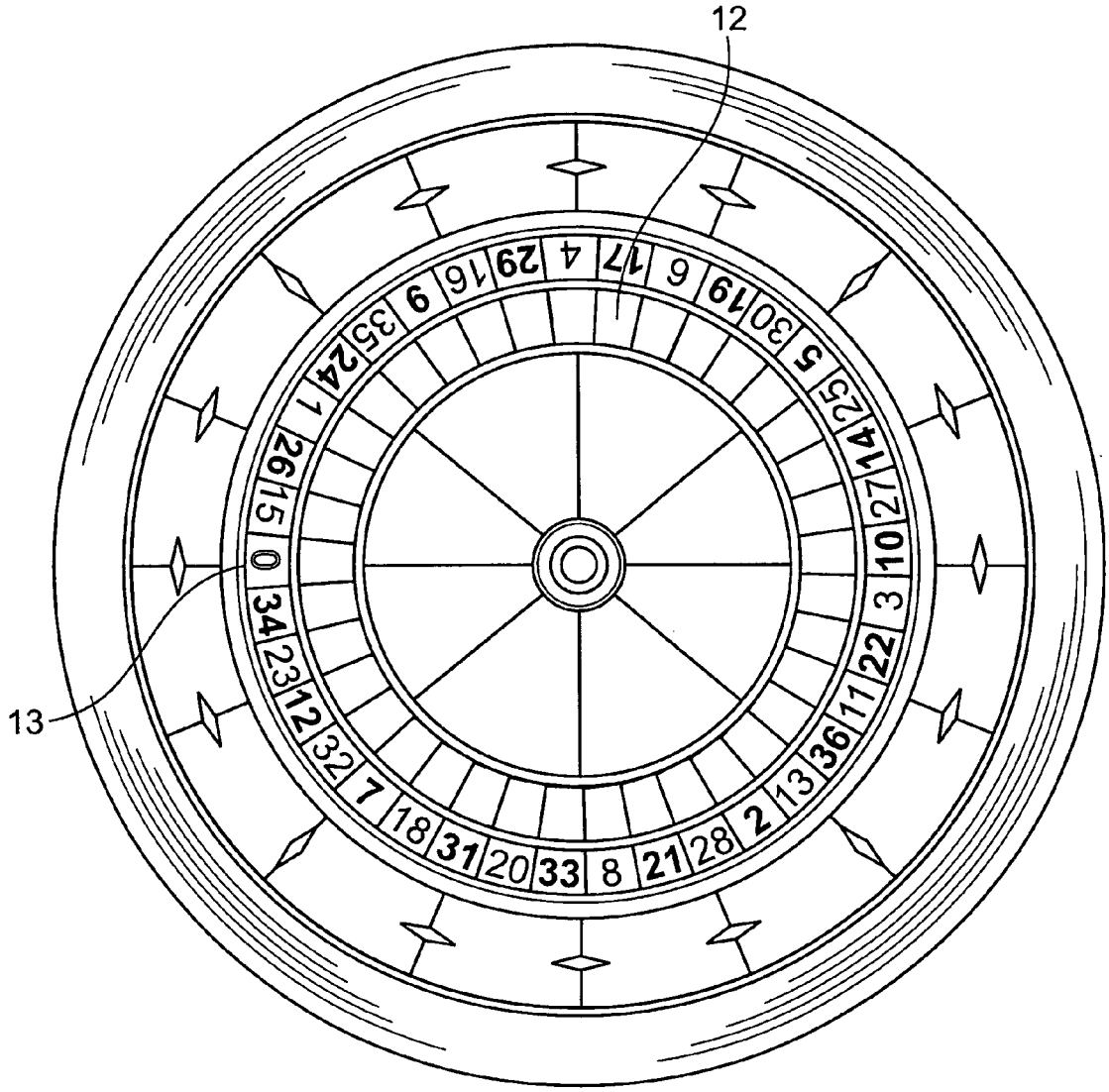
FIG. 6 shows a European roulette wheel arrangement for use with the game surface shown in FIG. 4, according to an embodiment of the invention.

As shown in FIG. 6, the pockets may be arranged in the following clockwise sequence with respect to a corresponding number: a house number, 15, 26, 1, 24, 35, 9, 16, 29, 4, 17, 6, 19, 30, 5, 25, 14, 27, 10, 3, 22, 11, 36, 13, 2, 28, 21, 8, 33, 20, 31, 18, 7, 32, 12, 23 and 34.

Figure 7:
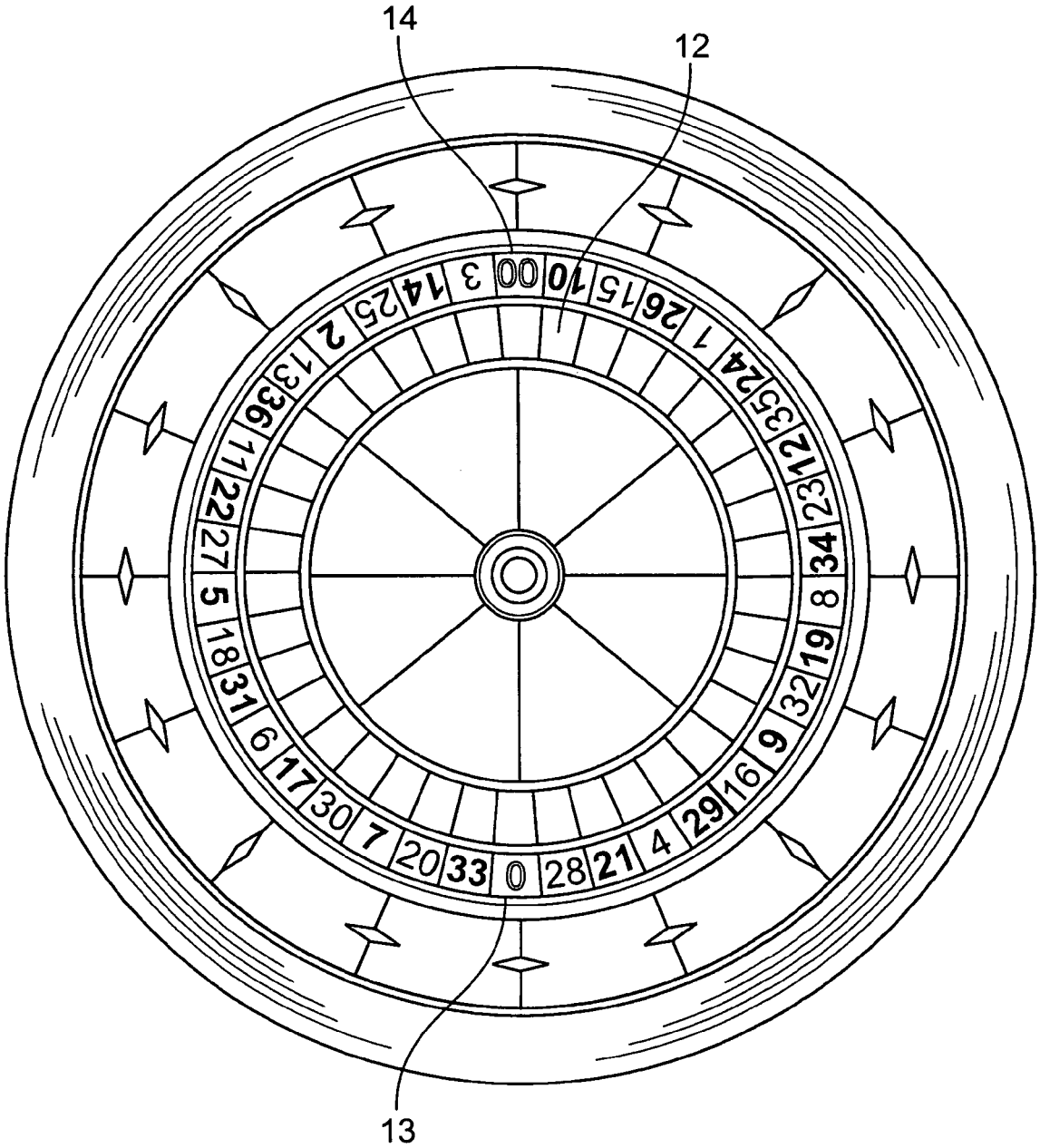
FIG. 7 shows another American roulette wheel arrangement for use with the game surface shown in FIG. 4, according to an embodiment of the invention.

As shown in FIG. 7, the pockets may be arranged in the following clockwise sequence with respect to a corresponding number: a first house number, 33, 20, 7, 30, 17, 6, 31, 18, 5, 27, 22, 11, 36, 13, 2, 25, 14, 3 a second house number, 10, 15, 26, 1, 24, 35, 12, 23, 34, 8, 19, 32, 9, 16, 29, 4, 21 and 28.

Figure 8:
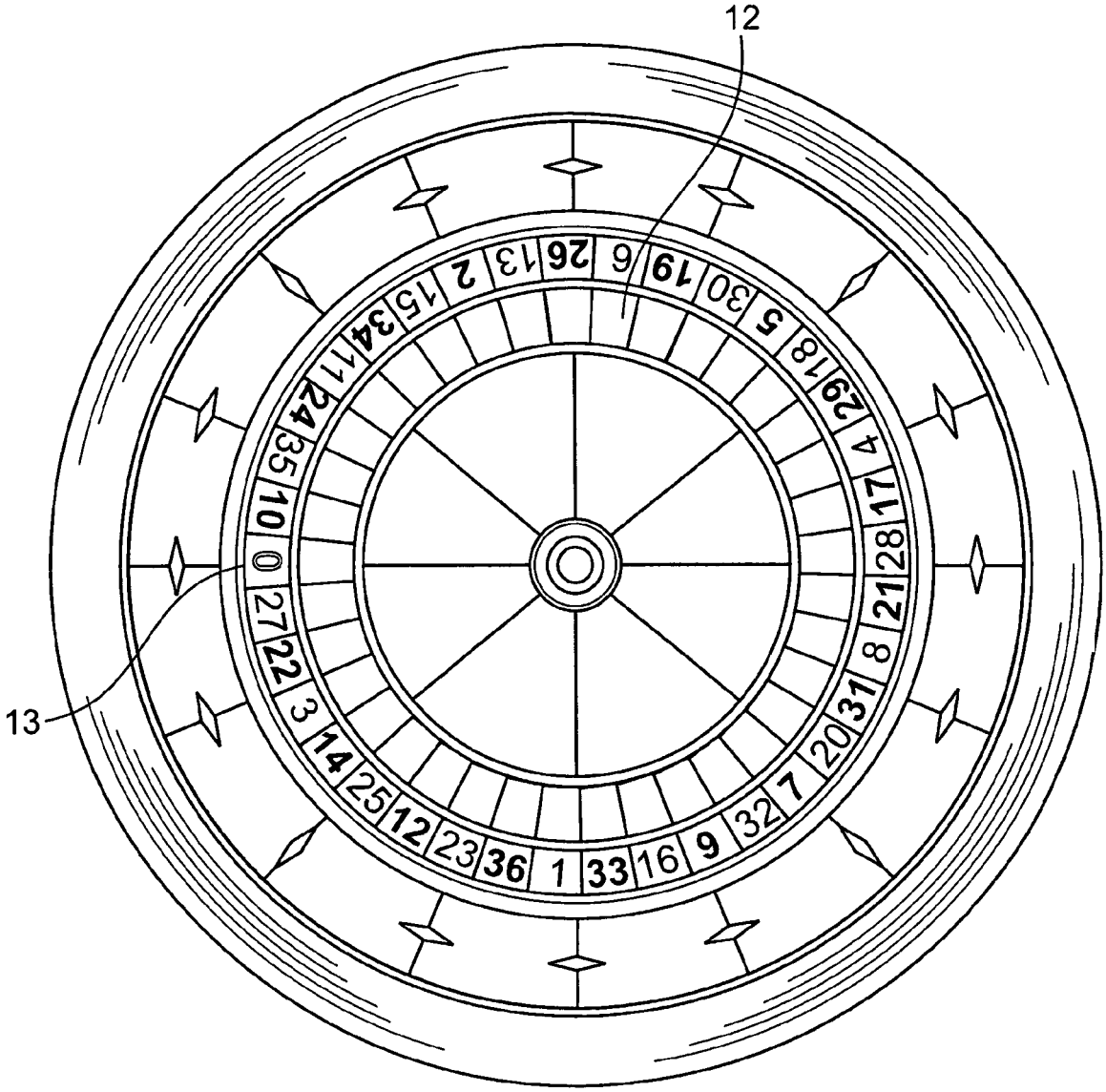
FIG. 8 shows another European roulette wheel arrangement for use with the game surface shown in FIG. 4, according to an embodiment of the invention.
Figure 9:
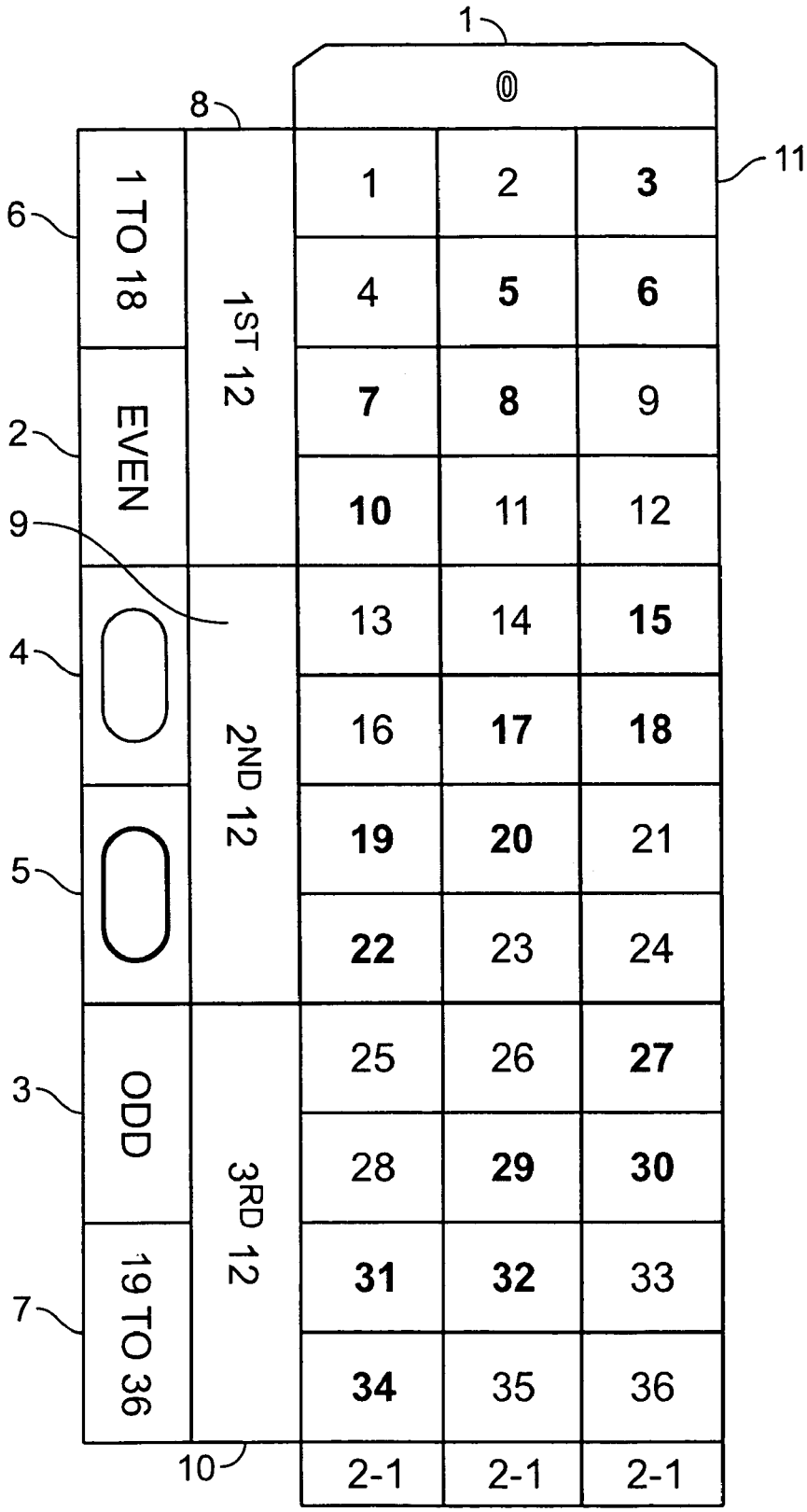
FIG. 9 shows a game surface according to another embodiment of the invention.

As shown in FIG. 8, the pockets may be arranged in the following clockwise sequence with respect to a corresponding number: a house number, 10, 35, 24, 11, 34, 15, 2, 13, 26, 6, 19, 30, 5, 18, 29, 4, 17, 28, 21, 8, 31, 20, 7, 32, 9, 16, 33, 1, 36, 23, 12, 25, 14, 3, 22, and 27.

As shown in FIG. 10, the pockets may be arranged in the following clockwise sequence with respect to a corresponding number: a house number, 34, 12, 19, 26, 15, 2, 27, 4, 17, 1, 30, 23, 10, 21, 32, 13, 8, 36, 7, 33, 20, 25, 18, 11, 22, 35, 6, 28, 3, 14, 31, 24, 5, 16, 29 and 9.

As shown in FIG. 11, the pockets may be arranged in the following clockwise sequence with respect to a corresponding number: a first house number, 7, 33, 20, 25, 18, 11, 22, 35, 6, 28, 3, 14, 31, 24, 5, 16, 29, 9, a second house number, 34, 12, 19, 26, 15, 2, 27, 4, 17, 1, 30, 23, 10, 21, 32, 13, 8 and 36.

As shown in FIG. 13, the pockets may be arranged in the following clockwise sequence with respect to a corresponding number: a house number, 24, 29, 6, 19, 30, 1, 20, 25, 2, 16, 33, 10, 35, 18, 7, 32, 13, 8, 15, 34, 9, 14, 31, 12, 17, 36, 11, 21, 28, 3, 22, 27, 4, 23, 30 and 5.

As shown in FIG. 14, the pocket may be arranged in the following clockwise sequence with respect to a corresponding number: a first house number, 15, 34, 9, 14, 31, 12, 17, 36, 11, 21, 28, 3, 22, 27, 4, 23, 30, 5, a second house number, 24, 29, 6, 19, 30, 1, 20, 25, 2, 16, 33, 10, 35, 18, 7, 32, 13, and 8.

Figure 16:
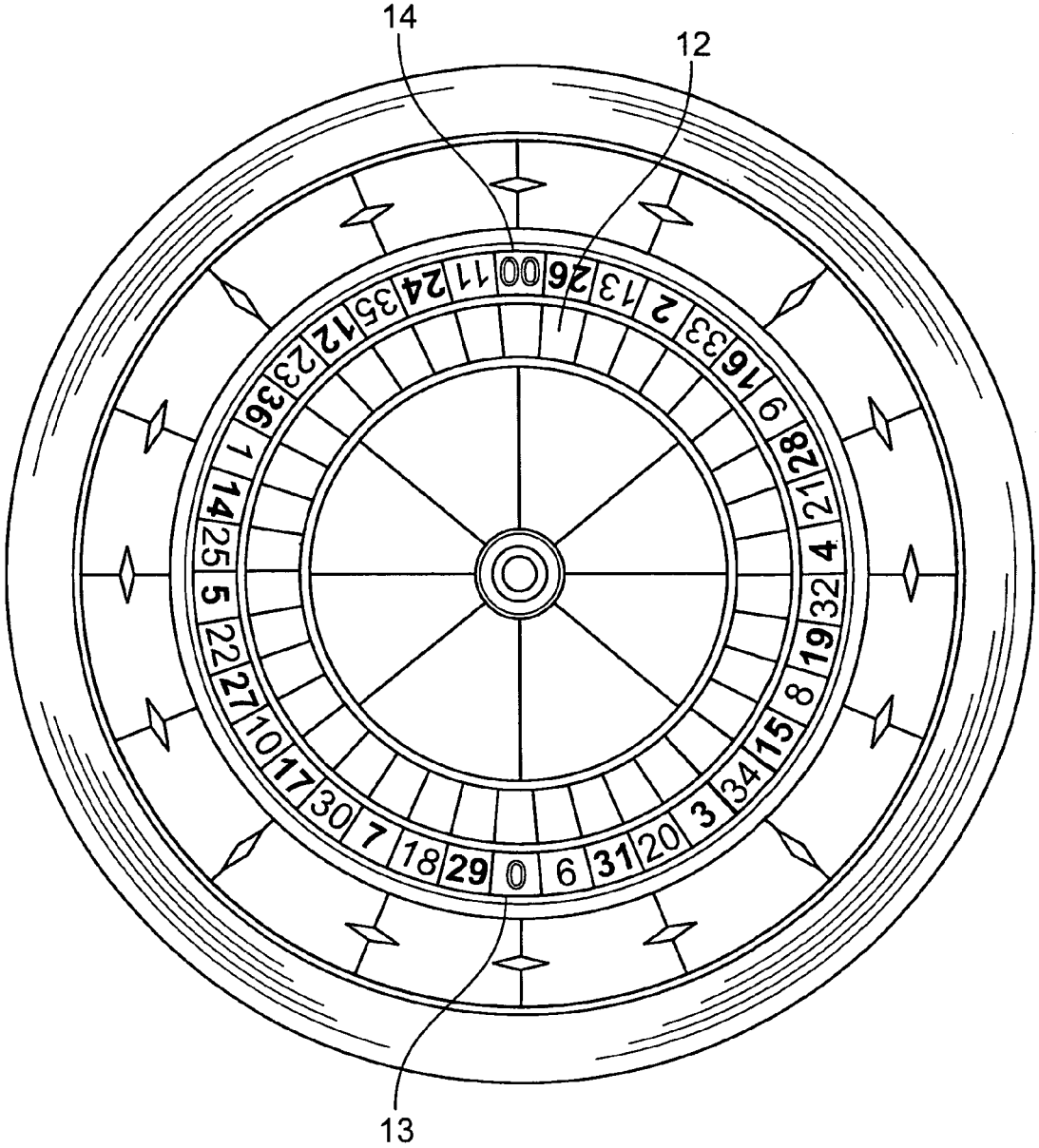
FIG. 16 shows an American roulette wheel arrangement for use with the game surface shown in FIG. 15, according to an embodiment of the invention.

As shown in FIG. 16, the pockets may be arranged in the following clockwise sequence with respect to a corresponding number: a first house number, 29, 18, 7, 30, 17, 10, 27, 22, 5, 25, 14, 1, 36, 23, 12, 35, 24, 11, a second house number, 26, 13, 2, 33, 16, 9, 28, 21, 4, 32, 19, 8, 15, 34, 3, 20, 31 and 6.

Figure 17:
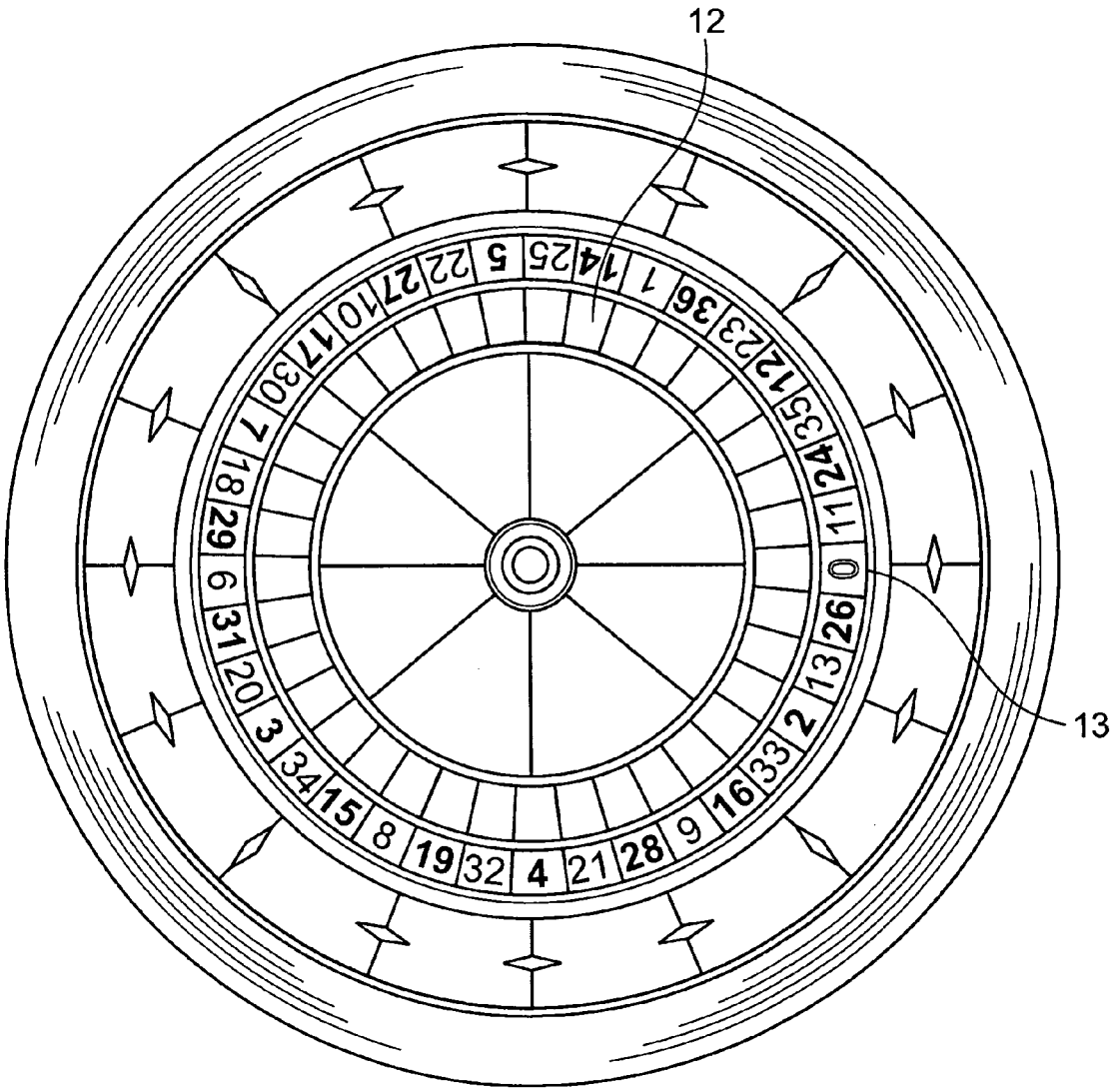
FIG. 17 shows a European roulette wheel arrangement for use with the game surface shown in FIG. 15, according to an embodiment of the invention.

As shown in FIG. 17, the pockets may be arranged in the following clockwise sequence with respect to a corresponding number: a house number, 26, 13, 2, 33, 16, 9, 28, 21, 4, 32, 19, 8, 15, 34, 3, 20, 31, 6, 29, 18, 7, 30, 17, 10, 27, 22, 5, 25, 14, 1, 36, 23, 12, 35, 24, and 11.

Figure 18:
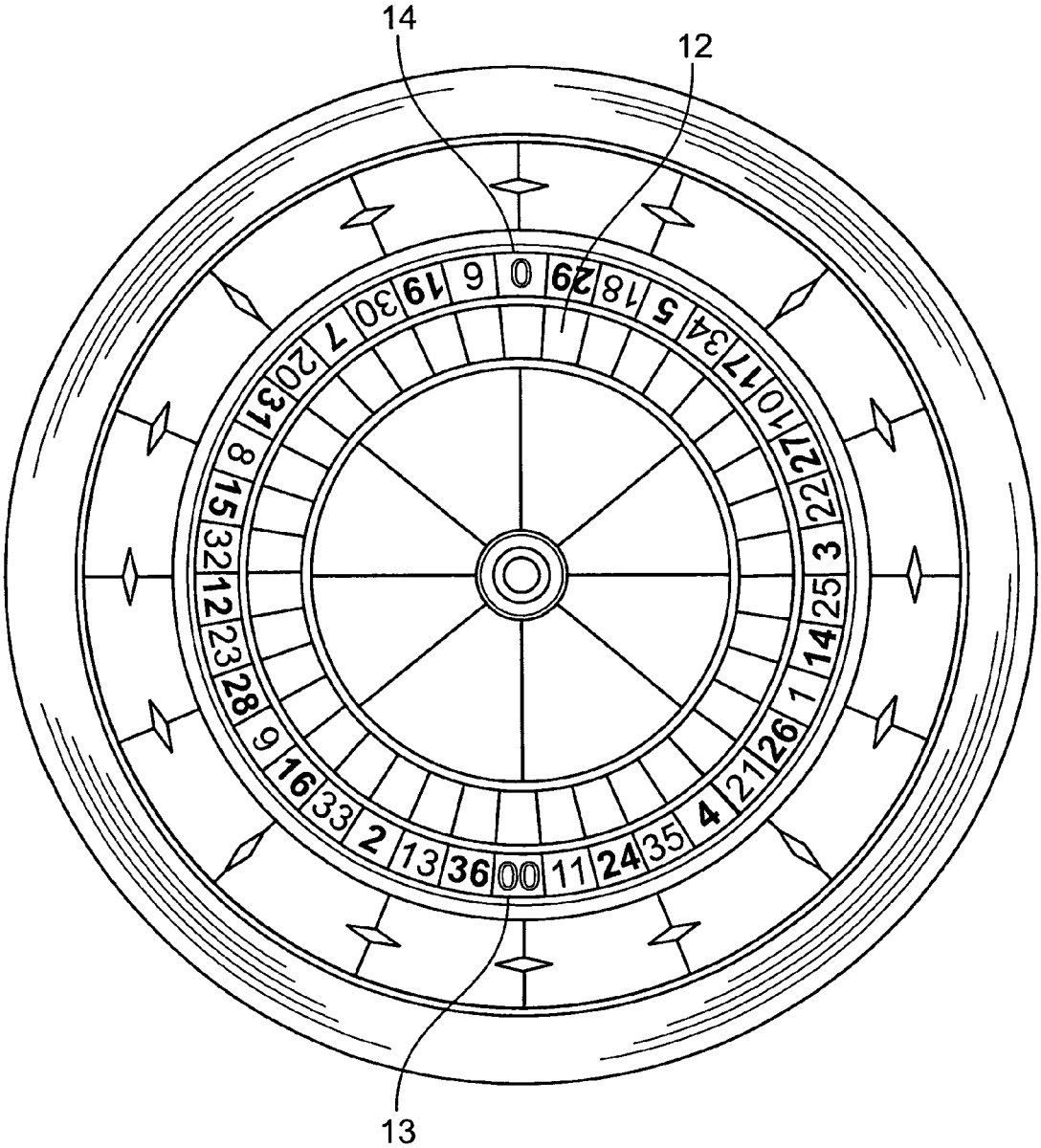
FIG. 18 shows another American roulette wheel arrangement for use with the game surface shown in FIG. 15, according to an embodiment of the invention.

As shown in FIG. 18, the pockets may be arranged in the following clockwise sequence with respect to a corresponding number: a first house number, 29, 18, 5, 34, 17, 10, 27, 22, 3, 25, 14, 1, 26, 21, 4, 35, 24, 11, a second house number, 36, 13, 2, 33, 16, 9, 28, 23, 12, 32, 15, 8, 31, 20, 7, 30, 19 and 6.

Figure 19:
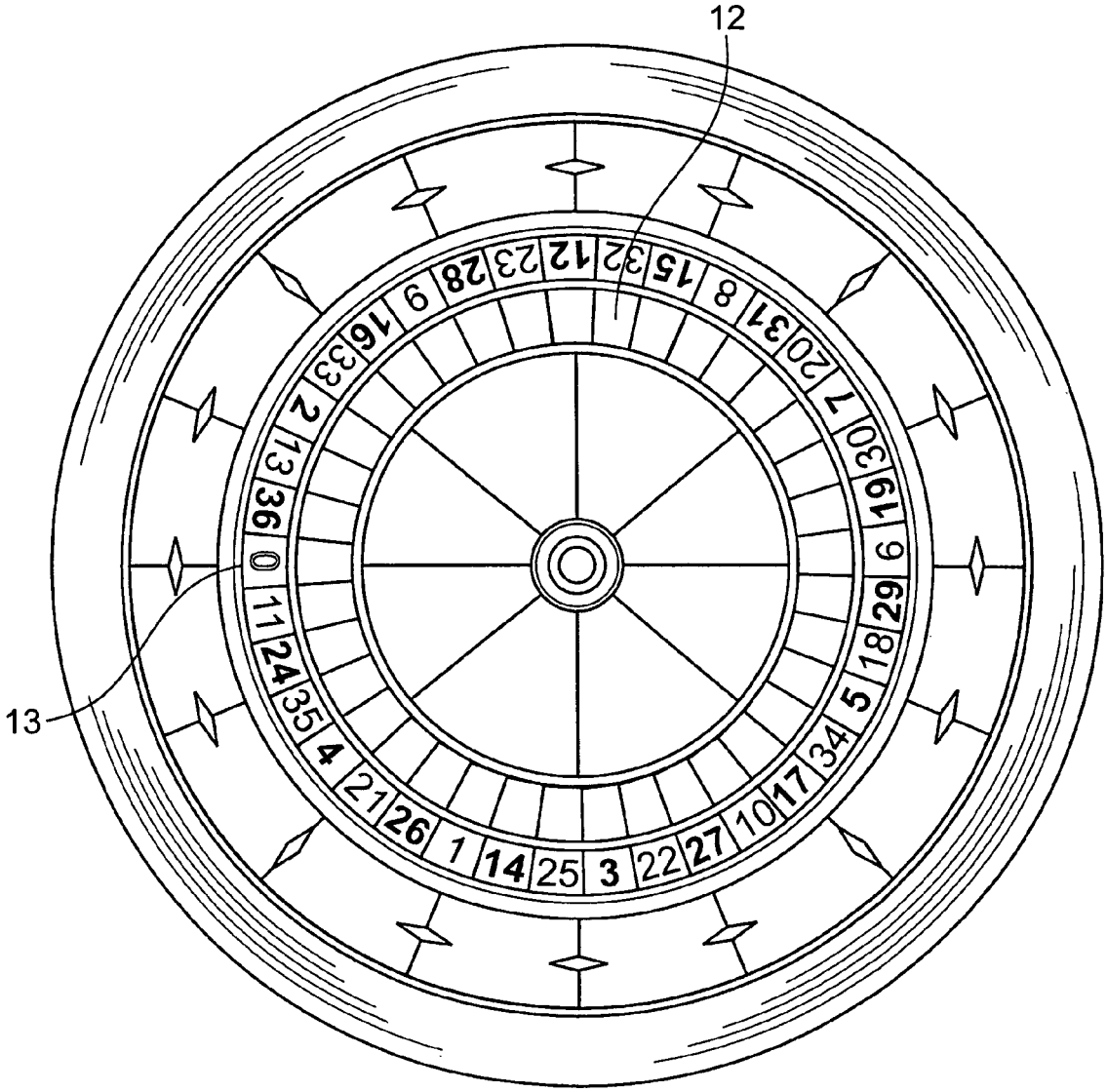
FIG. 19 shows another European roulette wheel arrangement for use with the game surface shown in FIG. 15, according to an embodiment of the invention.

As shown in FIG. 19, the pockets may be arranged in the following clockwise sequence with respect to a corresponding number: a house number, 36, 13, 2, 33, 16, 9, 28, 23, 12, 32, 15, 8, 31, 20, 7, 30, 19, 6, 29, 18, 5, 34, 17, 10, 27, 22, 3, 25, 14, 1, 26, 21, 4, 35, 24 and 11.

Figure 20:
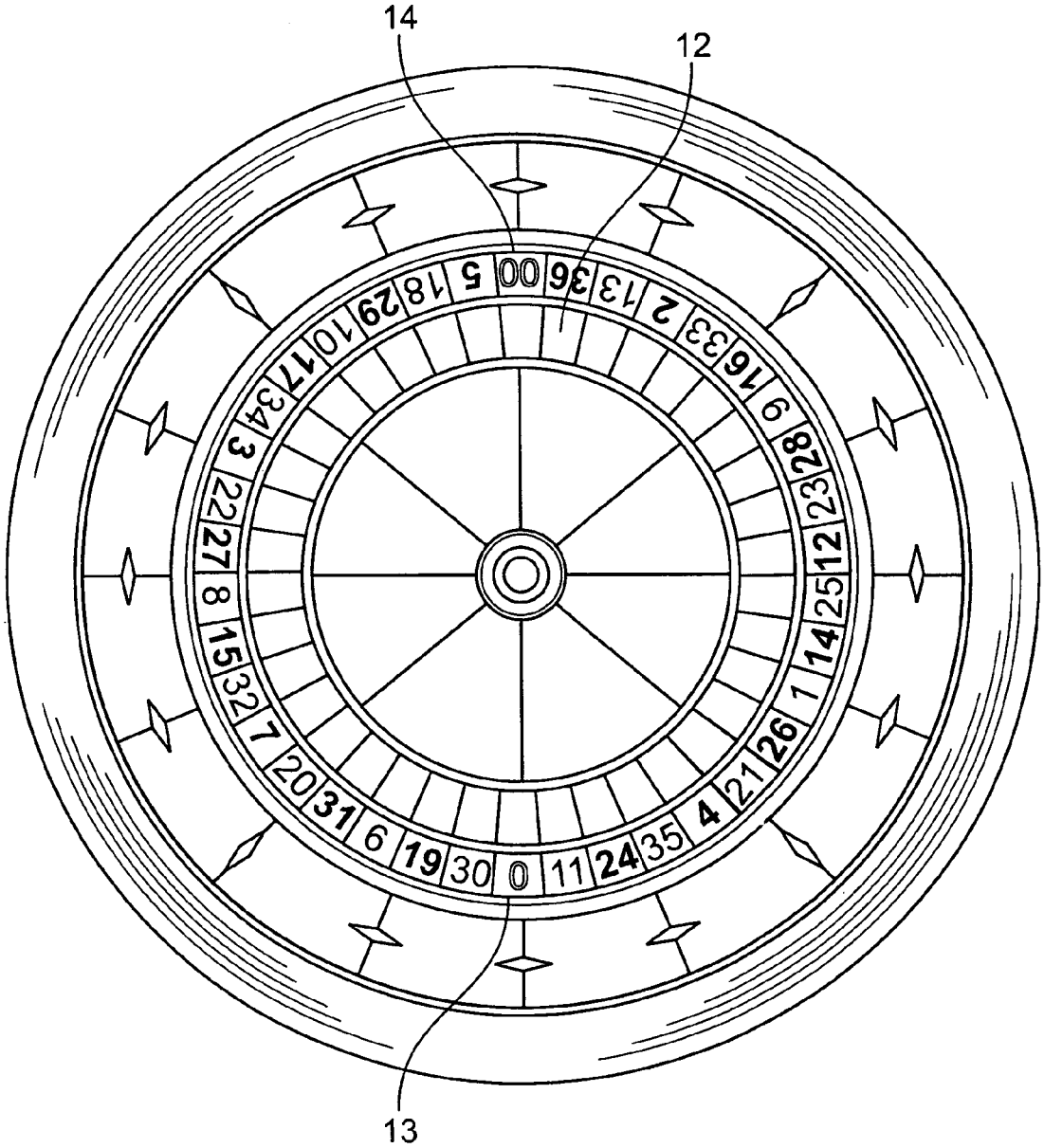
FIG. 20 shows another American roulette wheel arrangement for use with the game surface shown in FIG. 15, according to an embodiment of the invention.

As shown in FIG. 20, the pockets may be arranged in the following clockwise sequence with respect to a corresponding number: a first house number, 30, 19, 6, 31, 20, 7, 32, 15, 8, 27, 22, 3, 34, 17, 10, 29, 18, 5, a second house number, 36, 13, 2, 33, 16, 9, 28, 23, 12, 25, 14, 1, 26, 21, 4, 35, 24, and 11.

Figure 21:
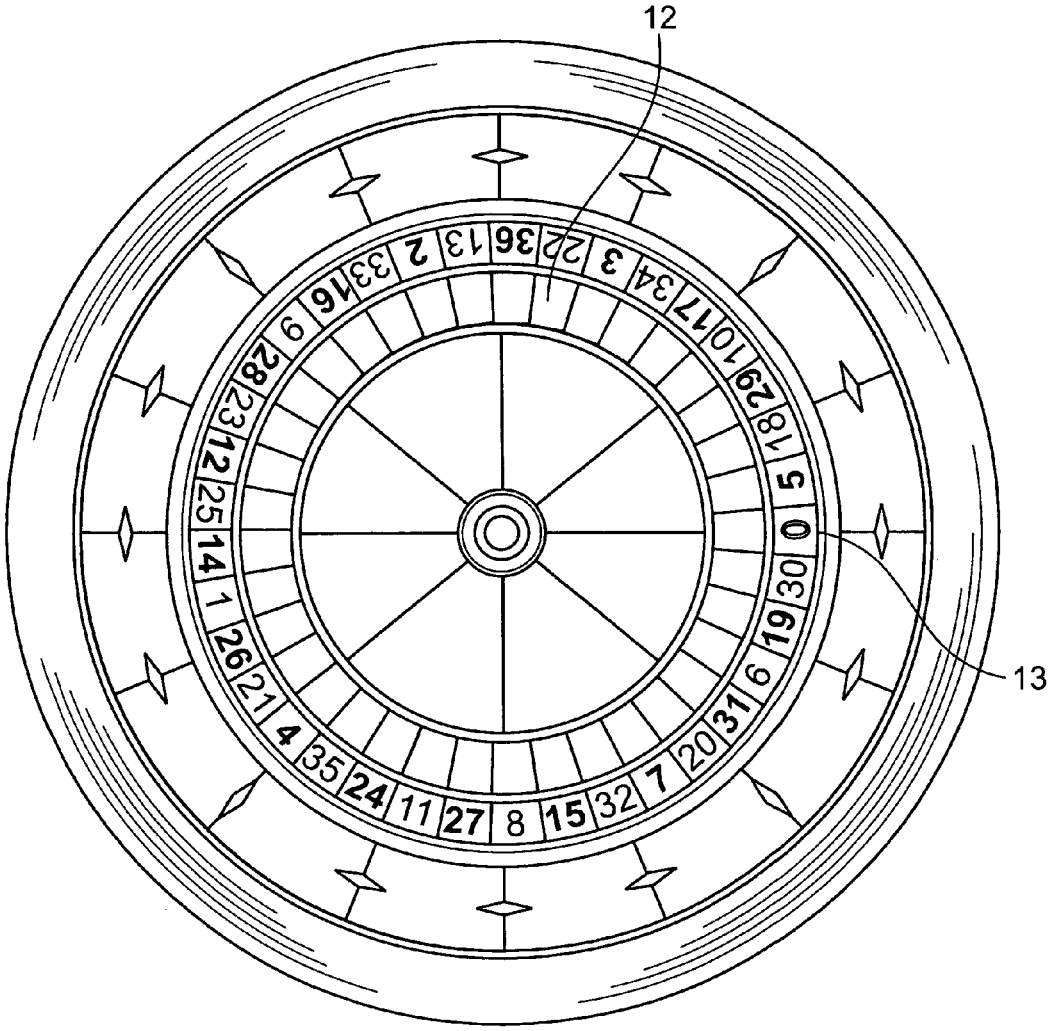
FIG. 21 shows another European roulette wheel arrangement for use with the game surface shown in FIG. 15, according to an embodiment of the invention.

As shown in FIG. 21, the pockets may be arranged in the following clockwise sequence with respect to a corresponding number: a house number, 30, 19, 6, 31, 20, 7, 32, 15, 8, 27, 11, 24, 35, 4, 21, 26, 1, 14, 25, 12, 23, 28, 9, 16, 33, 2, 13, 36, 22, 3, 34, 17, 10, 29, 18 and 5.

Figure 22:
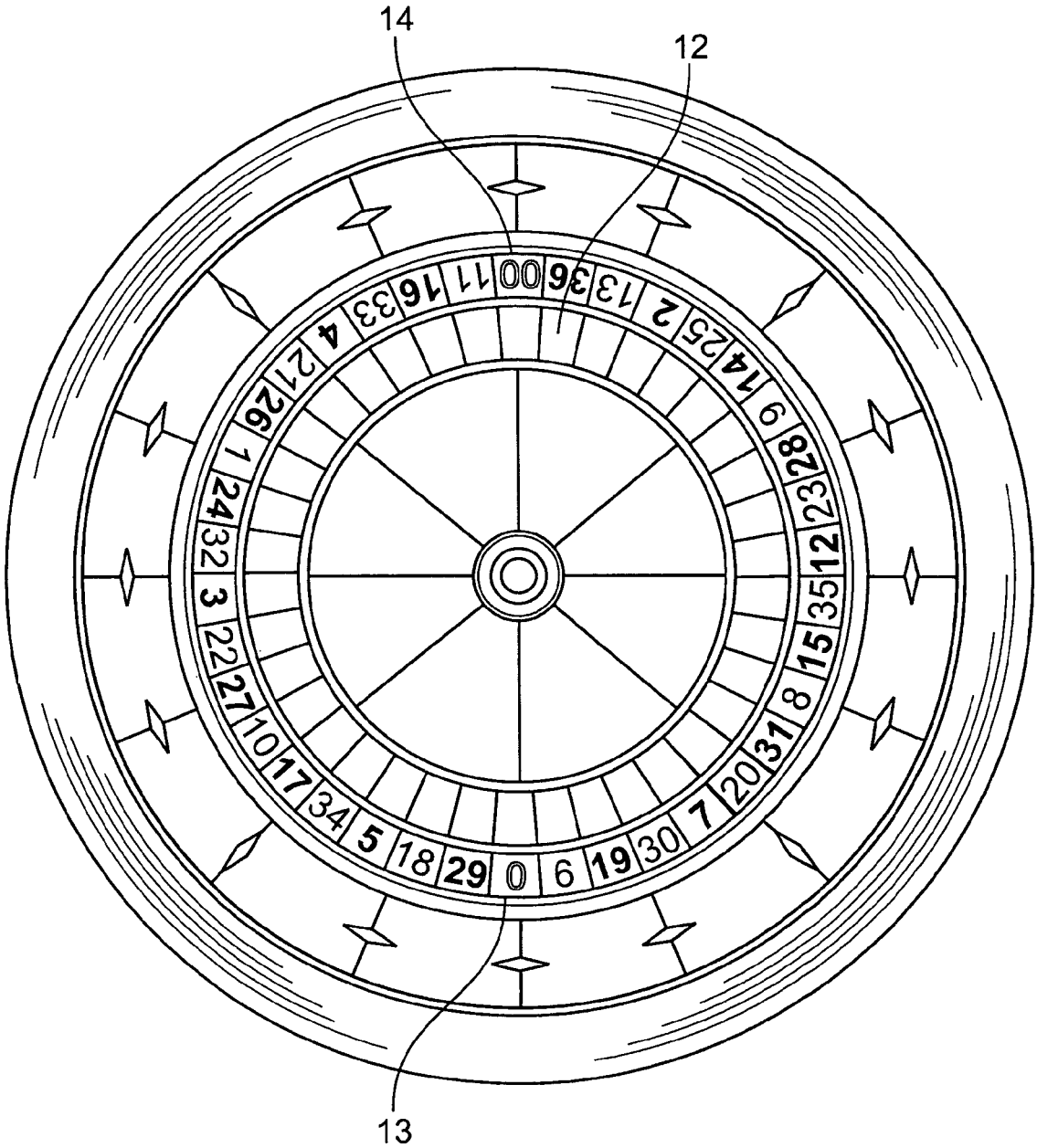
FIG. 22 shows another American roulette wheel arrangement for use with the game surface shown in FIG. 15, according to an embodiment of the invention.

As shown in FIG. 22, the pockets may be arranged in the following clockwise sequence with respect to a corresponding number: a first house number, 29, 18, 5, 34, 17, 10, 27, 22, 3, 32, 24, 1, 26, 21, 4, 33, 16, 11, a second house number, 36, 13, 2, 25, 14, 9, 28, 23, 12, 35, 15, 8, 31, 20, 7, 30, 19 and 6.

Figure 23:
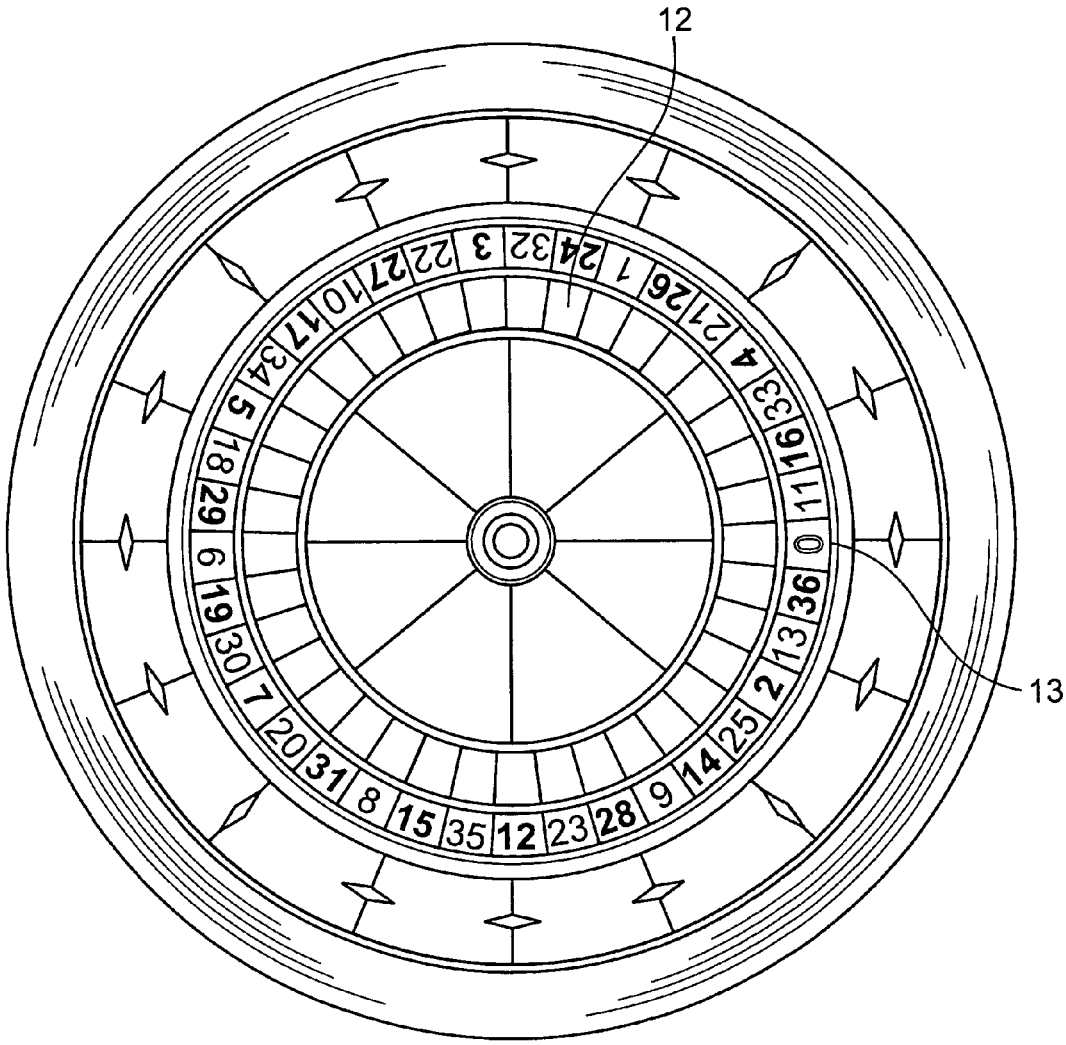
FIG. 23 shows another European roulette wheel arrangement for use with the game surface shown in FIG. 15, according to an embodiment of the invention.

As shown in FIG. 23, the pockets may be arranged in the following clockwise sequence with respect to a corresponding number: a house number, 36, 13, 2, 25, 14, 9, 28, 23, 12, 35, 15, 8, 31, 20, 7, 30, 19, 6, 29, 18, 5, 34, 17, 10, 27, 22, 3, 32, 24, 1, 26, 21, 4, 33, 16 and 11.

As shown in FIG. 25, the pockets may be arranged in the following clockwise sequence with respect to a corresponding number: a house number, 8, 15, 28, 9, 16, 29, 4, 17, 27, 2, 21, 34, 3, 22, 35, 10, 23, 30, 11, 24, 25, 6, 13, 26, 1, 14, 36, 5, 18, 31, 12, 19, 32, 7, 20, and 33.

As shown in FIG. 27, the pockets may be arranged in the following clockwise sequence with respect to a corresponding number: a first house number, 8, 15, 28, 9, 16, 29, 4, 17, 27, 2, 21, 34, 3, 22, 35, 10, 23, 30, a second house number, 11, 24, 25, 6, 13, 26, 1, 14, 36, 5, 18, 31, 12, 19, 32, 7, 20 and 33.

A further advantage of an embodiment of the invention is that roulette wheel arrangements are presented wherein the sequence of numbers on an American style roulette wheel is substantially the same as the sequence of numbers on a European style wheel for use with the same game surface. For example, the sequence of numbers on the American style wheel shown in FIG. 11 is substantially the same as the sequence on the European style wheel shown in FIG. 10. Likewise, the sequence of numbers on the American style wheel shown in FIG. 14 is substantially the same as the sequence on the European style wheel shown in FIG. 13; the sequence of numbers on the American style wheel shown in FIG. 16 is substantially the same as the sequence on the European style wheel shown in FIG. 17; the sequence of numbers on the American style wheel shown in FIG. 18 is substantially the same as the sequence on the European style wheel shown in FIG. 19; the sequence of numbers on the American style wheel shown in FIG. 22 is substantially the same as the sequence on the European style wheel shown in FIG. 23; and the sequence of numbers on the American style wheel shown in FIG. 27 is substantially the same as the sequence on the European style wheel shown in FIG. 25. The only difference in the pairs of wheels is the placement of the additional house number (00) in the American style wheels.

A further advantage of a roulette game surface and wheel arrangement according to an embodiment of the invention is that the arrangement of numbers, colors and odd and even numbers is significantly more balanced than in the prior art arrangements.

Figure 2:
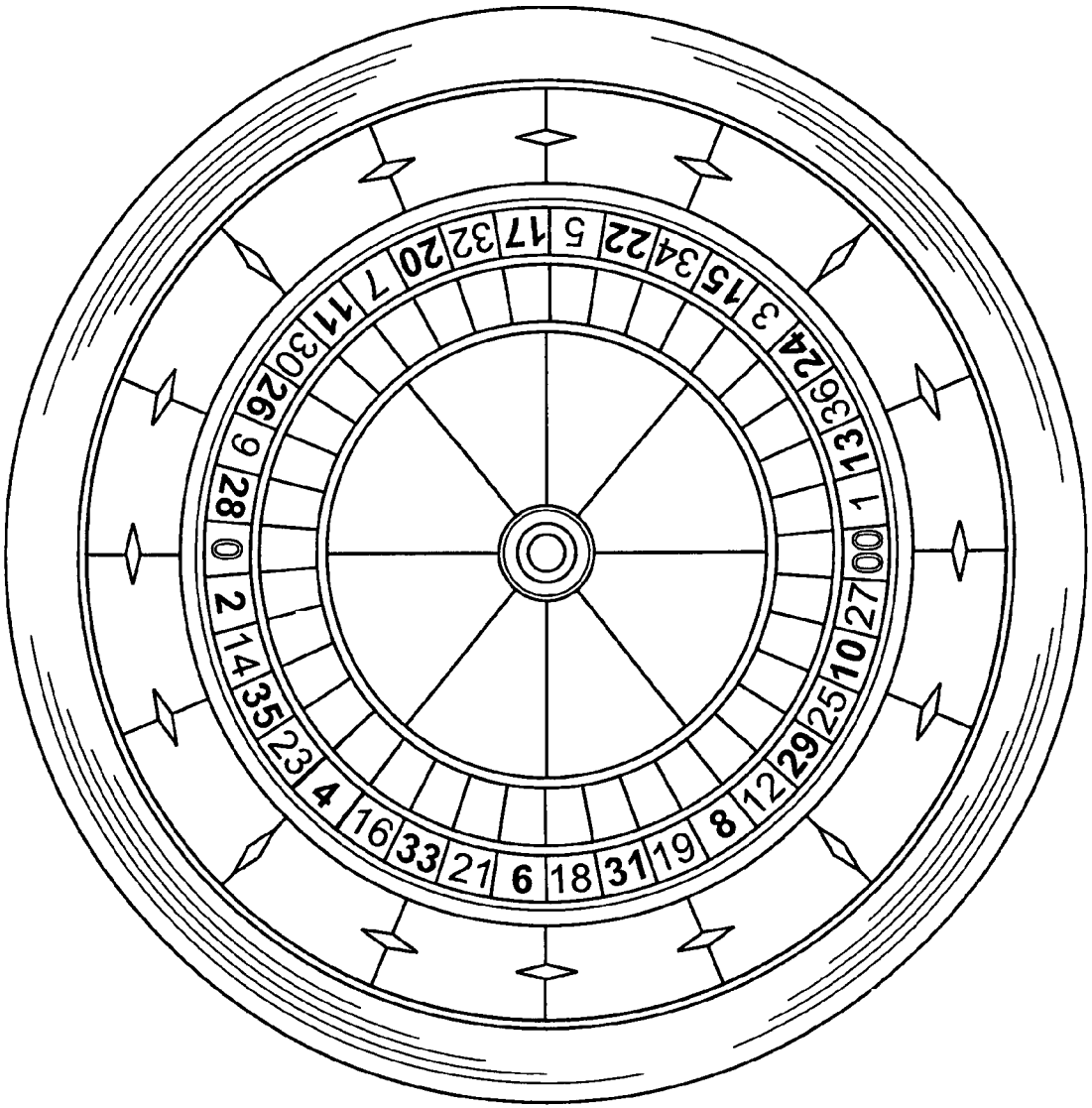
FIG. 2 (Prior Art)
FIG. 2 shows a prior art American wheel arrangement for a use with the prior art game surface shown in FIG. 1.
Figure 3:
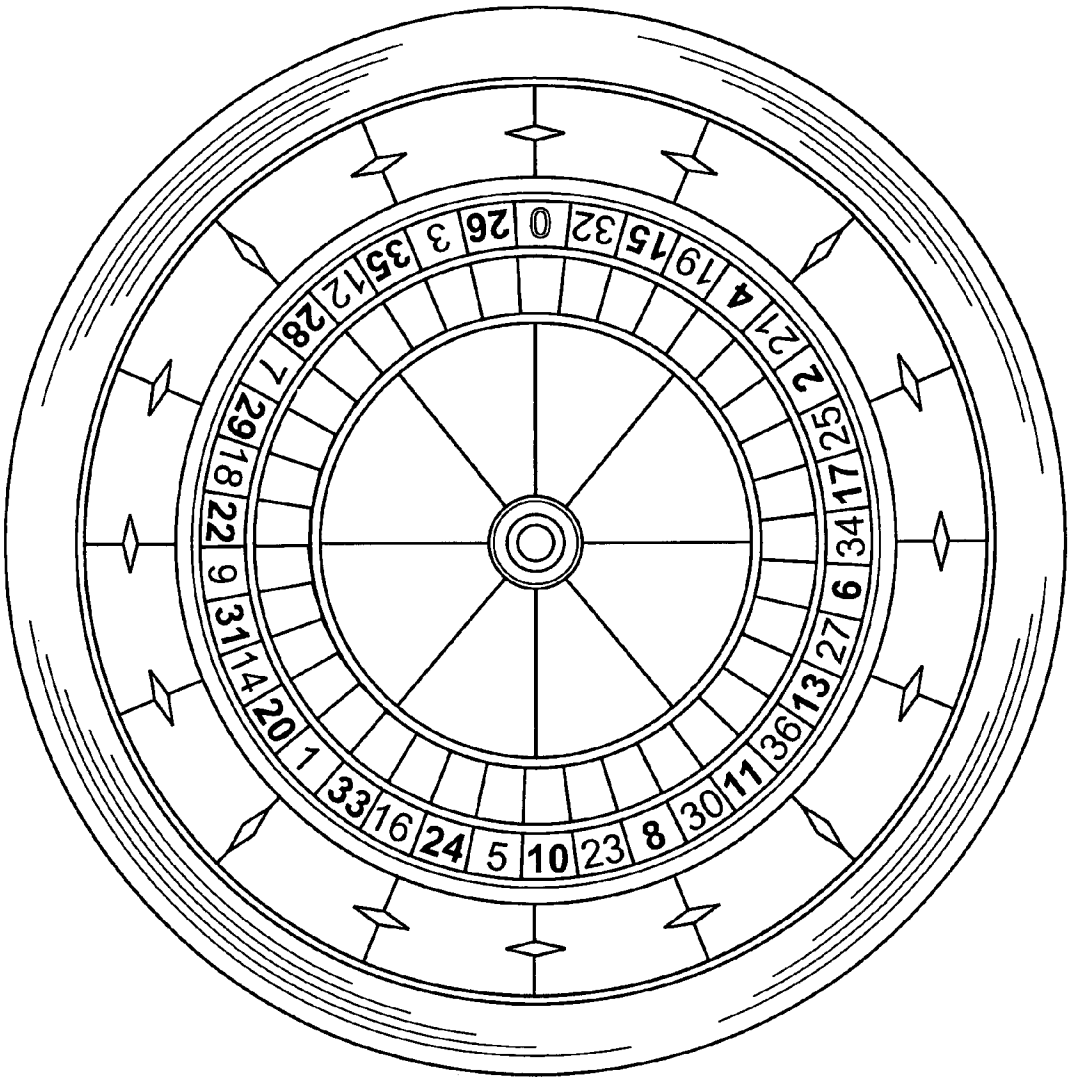
FIG. 3 (Prior Art)
FIG. 3 shows a prior art European wheel arrangement for a use with the prior art game surface shown in FIG. 1.

In the prior art arrangements shown in FIGS. 1-3, the sum of the eight odd black numbers (11, 13, 15, 17, 29, 31, 33 and 35) equals 184, and the sum of the ten odd red numbers (1, 3, 5, 7, 9, 19, 21, 23, 25, and 27) equals 140, giving a total of 324 as the sum of the odd numbers. The sum of the ten even black numbers in the prior art arrangements shown in FIGS. 1-3 (2, 4, 6, 8, 10, 20, 22, 24, 26, and 28) equals 150 and the sum of the eight even red numbers (12, 14, 16, 18, 30, 32, 34 and 36) equals 192, giving a total of 342 as the sum of the even numbers. The sum of the eight black odd numbers (184) and the ten black even numbers (150) equals 334, while the sum of the ten red odd numbers (140) and the eight red even numbers (192) is only 332 in the prior art arrangements.

In the arrangements shown in FIGS. 24-27, for example, the sum of the nine odd black numbers (5, 7, 9, 15, 17, 19, 29, 31, and 33) equals 165, and the sum of the nine odd red numbers (1, 3, 11, 13, 21, 23, 25, 27, and 35) equals 159, giving a total of 324 as the sum of the odd numbers. The sum of the nine even black numbers in the arrangements shown in FIGS. 24-27 (2, 6, 10, 14, 22, 24, 26, 30 and 34) equals 168 and the sum of the nine even red numbers (4, 8, 12, 16, 18, 20, 28, 32 and 36) equals 174, giving a total of 342 as the sum of the even numbers. Additionally, the sum of the nine black odd numbers (165) and the nine black even numbers (168) equals 333, which is the same as the sum of the nine red odd numbers (159) and the nine red even numbers (174). These relationships are true for both the American and European arrangements.

Additionally, in the American wheel arrangement shown in FIG. 27, the sum of the odd numbers on one side of the wheel between the 0 and 00 positions (15, 9, 29, 17, 27, 21, 3, 35, and 23) equals 179 and the sum of the even numbers on the same half of the wheel (8, 28, 16, 4, 2, 34, 22, 10 and 30) is 154, giving a total of 333. The sum of the odd numbers between the 0 and 00 positions on the opposite side of the wheel (11, 25, 13, 1, 5, 31, 19, 7, and 33) is 145 and the sum of the even numbers on the same half of the wheel (24, 6, 26, 14, 36, 18, 12, 32, and 20) is 188, also giving a total of 333. Thus the wheel is perfectly balanced. Moreover, the sum of the numbers between the two house numbers on one side of American wheel shown in FIG. 22 is exactly equal to the sum of the numbers between the two house numbers on the other side of the wheel, 333, evidencing the perfect balance of numbers on a wheel arrangement according to an embodiment of the invention.

As shown in FIGS. 2 and 3, the prior art roulette wheel arrangements alternate odd and even numbers around the wheel. The only place on the prior art roulette wheels where two odd numbers or two even numbers are grouped together is around the house number (0 or 00). For example, in the prior art American roulette wheel shown in FIG. 2, the two even numbers 28 and 2 are separated by the house number 0 and the two odd numbers 27 and 1 are separated by the house number 00.

In roulette wheel arrangements according to embodiments of the invention, however, a pair of adjacent odd numbers and a pair of adjacent even numbers may be positioned diametrically opposite one another on the wheel at positions disposed away from the house number. For example in the wheel shown in FIG. 11, the pair of adjacent even numbers 28, 6 is located directly opposite the pair of adjacent odd numbers 1, 17. This arrangement of positioning the pairs of adjacent even and odd numbers away from the house numbers allows for more consistent play in wheels according to embodiments of the invention and eliminates betting strategies involving the house number (the "green game").

Accordingly, while several embodiments of the present invention have been shown and described, it is obvious that many changes and modifications may be made thereunto without departing from the spirit and scope of the invention.

What is claimed is:

1. A method for balancing an arrangement of indicia on a game surface and on an associated roulette wheel for a roulette game, the method comprising the steps of:

a) arranging indicia indicating one or more house numbers on the game surface;

b) arranging indicia indicating thirty six whole numbers comprising the numbers 1 through 36, wherein one half of the whole numbers are associated with a first color and a remaining half of the whole numbers are associated with a second color, on the game surface in a matrix of three columns and twelve rows, the whole numbers being arranged in ascending order beginning from a top left corner and proceeding from left to right across the rows;

wherein the whole numbers are arranged in three groups of twelve numbers each, a first group comprising the numbers 1 through 12, a second group comprising the numbers 13 through 24 and a third group comprising the numbers 25 through 36; and wherein each of said first, second and third group comprise three even numbers associated with the first color, three odd numbers associated with first color, three even numbers associated with the second color and three odd numbers associated with the second color;

c) arranging indicia indicating the one or more house numbers on the roulette wheel; and d) arranging indicia indicating each of the thirty six whole numbers on the roulette wheel in a circumferential manner by:

selecting a first whole number associated with the first color or the second color and disposed in one of the three columns and one of the three groups and indicating the first whole number on the roulette wheel;

selecting a second whole number associated with another of the first color or the second color and disposed in another of the three columns and another of the three groups and indicating the second whole number on the roulette wheel adjacent to the first number; and repeating this pattern on the roulette wheel such that no two adjacent numbers on the roulette wheel are associated with a same color, are disposed in a same group on the game surface, are disposed in a same column on the game surface, are disposed in a same row on the game surface, and are disposed adjacent one another on the game surface, said pattern providing a balance of color and numbers on the roulette wheel with respect to the game surface, and such that each pair of numbers disposed substantially diametrically across from one another on the roulette wheel is disposed in the same group on the game surface and in the same column on the game surface.

2. The method as claimed in claim 1, wherein said arranging indicia indicating thirty six whole numbers comprising the numbers 1 through 36 on the game surface defines:

i) one or more house number wagering areas;

ii) an even number wagering area;

iii) an odd number wagering area;

iv) a first color wagering area;

v) a second color wagering area;

vi) a low number wagering area corresponding to a whole number from 1to 18;

vii) a high number wagering area corresponding to a whole number from 19 to 36;

viii) a first dozen wagering area corresponding to a whole number from 1 to 12;

ix) a second dozen wagering area corresponding to a whole number from 13 to 24;

x) a third dozen wagering area corresponding to a whole number from 25 to 36; and xi) thirty six individual number wagering areas, each corresponding to a whole number from 1 to 36, said thirty six individual number wagering areas arranged in ascending order from left to fight in a matrix of three columns and twelve rows and in three groups of twelve numbers each, a first group comprising the numbers 1 through 12, a second group comprising the numbers 13 through 24 and a third group comprising the numbers 25 through 36; wherein individual number wagering areas corresponding to numbers 1, 3, 4, 8, 11, 12, 13, 16, 18, 20, 21, 23, 25, 27, 28, 32, 35 and 36 are associated with said first color, and individual number wagering areas corresponding to numbers 2, 5, 6, 7, 9, 10, 14, 15, 17, 19, 22, 24, 26, 29, 30, 31, 33 and 34 are associated with said second color.

3. The method according to claim 2, wherein said roulette wheel comprises a plurality of pockets disposed in a circumferential manner, each of said pockets corresponding to a house number or to a whole number from 1 to 36, wherein said pockets are arranged in the following clockwise sequence with respect to a corresponding number: a first house number, 8, 15, 28, 9, 16, 29, 4, 17, 27, 2, 21, 34, 3, 22, 35, 10, 23, 30, a second house number, 11, 24, 25, 6, 13, 26, 1, 14, 36, 5, 18, 31, 12, 19, 32, 7, 20 and 33.

4. The method according to claim 2, wherein said roulette wheel comprises a plurality of pockets disposed in a circumferential manner, each of said pockets corresponding to a house number or to a whole number from 1 to 36, wherein said pockets are arranged in the following clockwise sequence with respect to a corresponding number: a house number, 8, 15, 28, 9, 16, 29, 4, 17, 27, 2, 21, 34, 3, 22, 35, 10, 23, 30, 11, 24, 25, 6, 13, 26, 1, 14, 36, 5, 18, 31, 12, 19, 32, 7, 20 and 33.

* * * * *